US010828659B2

(12) United States Patent
Grismer et al.

(10) Patent No.: US 10,828,659 B2
(45) Date of Patent: Nov. 10, 2020

(54) INSULATING GLASS UNIT FINAL SEALING ASSEMBLY AND METHOD

(71) Applicant: GED INTEGRATED SOLUTIONS, INC., Glenwillow, OH (US)

(72) Inventors: John Grismer, Cuyahoga Falls, OH (US); Paul A. Hofener, Parma, OH (US); Brady S. Jacot, Stow, OH (US); Steven W. Pesek, Hinckley, OH (US); William A. Briese, Hinckley, OH (US)

(73) Assignee: GED Integrated Solutions, Inc., Glenwillow, OH (US)

( * ) Notice: Subject to any disclaimer, the term of this patent is extended or adjusted under 35 U.S.C. 154(b) by 0 days.

(21) Appl. No.: 15/970,451

(22) Filed: May 3, 2018

(65) Prior Publication Data

US 2018/0339307 A1 Nov. 29, 2018

Related U.S. Application Data

(60) Provisional application No. 62/629,785, filed on Feb. 13, 2018, provisional application No. 62/539,779, (Continued)

(51) Int. Cl.
*B05C 5/02* (2006.01)
*E06B 3/673* (2006.01)
(Continued)

(52) U.S. Cl.
CPC ..... *B05C 5/0216* (2013.01); *B05C 11/1005* (2013.01); *B05C 11/1021* (2013.01);
(Continued)

(58) Field of Classification Search
USPC ..... 118/323, 321, 712, 713, 300, 302, 118/665–667, 679–682
See application file for complete search history.

(56) References Cited

U.S. PATENT DOCUMENTS 4,711,692 A 12/1987 Lisec
5,968,297 A 10/1999 Hooker et al.
(Continued)

FOREIGN PATENT DOCUMENTS

JP 2004243215 A * 9/2004

OTHER PUBLICATIONS

English Translation JP-2004243215A (Year: 2004).*
(Continued)

*Primary Examiner* — Yewebdar T Tadesse
(74) *Attorney, Agent, or Firm* — Tarolli, Sundheim, Covell & Tummino LLP; John A. Yirga, Esq.

(57) ABSTRACT

A window sealing system and method for use in sealing insulating glass units (IGUs) is disclosed herein. The system includes an articulating arm having a plurality of members and arms to allow movement about multiple axes defined by the articulating arm, and a sealant dispensing apparatus releasably couplable to the articulating arm. The sealant dispensing apparatus comprises a pivotable dispensing apparatus for dispensing sealant onto an IGU. The system further including a vision system, coupled to the sealant dispensing apparatus, for monitoring physical properties of the sealant during sealant application.

20 Claims, 19 Drawing Sheets

Related U.S. Application Data filed on Aug. 1, 2017, provisional application No. 62/500,704, filed on May 3, 2017.

(51) Int. Cl.

| | |
|---|---|
| ***B05C 9/14*** | (2006.01) |
| ***E06B 3/663*** | (2006.01) |
| ***B05C 11/10*** | (2006.01) |
| *B05C 11/02* | (2006.01) |

(52) U.S. Cl.

CPC ..... *E06B 3/663* (2013.01); *E06B 3/67321* (2013.01); *B05C 9/14* (2013.01); *B05C 11/02* (2013.01); *E06B 3/67391* (2013.01); *E06B 2003/6638* (2013.01)

(56) References Cited

U.S. PATENT DOCUMENTS

| | | | | |
|---|---|---|---|---|
| 6,250,358 | B1 | 6/2001 | Lafond | |
| 7,048,964 | B2 | 5/2006 | McGlinchy et al. | |
| 7,921,064 | B2 | 4/2011 | McGlinchy et al. | |
| 8,250,023 | B2 | 8/2012 | McGlinchy et al. | |
| 8,651,046 | B1 | 12/2014 | Davancens et al. | |
| 2002/0071772 | A1* | 6/2002 | Isogai ..... | F04C 11/005 417/292 |
| 2006/0093742 | A1 | 5/2006 | McGlinchy et al. | |
| 2011/0179995 | A1* | 7/2011 | Chang ..... | B05B 12/122 118/500 |
| 2015/0063936 | A1 | 3/2015 | Azzarello et al. | |
| 2015/0259970 | A1* | 9/2015 | Briese ..... | E06B 3/67386 156/109 |
| 2017/0050213 | A1 | 2/2017 | Pringle, IV et al. | |
| 2017/0074030 | A1 | 3/2017 | Briese et al. | |

OTHER PUBLICATIONS

International Search Report and Written Opinion of International Searching Authority dated Jul. 27, 2018 for PCT International Application No. PCT/US2018/030922, filed May 3, 2018. PCT International Application No. PCT International Application No. PCT/US2018/030922 corresponds to and claims priority from the present application. (10 pages).

Notification Concerning Transmittal of International Preliminary Report on Patentability and International Preliminary Report on Patentability dated Nov. 14, 2019 for PCT International Application No. PCT/US2018/030922, filed May 3, 2018. PCT International Application No. PCT International Application No. PCT/US2018/030922 corresponds to and claims priority from the present application. (10 pages).

* cited by examiner

INSULATING GLASS UNIT FINAL SEALING ASSEMBLY AND METHOD

CROSS REFERENCES TO RELATED APPLICATIONS

The following application claims priority under 35 U.S.C. 119(e) to U.S. Provisional Patent Application Ser. No. 62/500,704 filed May 3, 2017 entitled INSULATING GLASS UNIT FINAL SEALING ASSEMBLY AND METHOD, U.S. Provisional Patent Application Ser. No. 62/629,785 filed Feb. 13, 2018 entitled INSULATING GLASS UNIT PLUG AND INSTALLATION METHOD, AND U.S. Provisional Patent Application Ser. No. 62/539,779 filed Aug. 1, 2017 entitled INSULATING GLASS UNIT FLUID EXCHANGE ASSEMBLY AND METHOD. The above-identified provisional applications are incorporated herein by reference in their entireties for all purposes.

TECHNICAL FIELD

The present disclosure relates to an insulting glass unit (IGU) sealing system and method, and more particularly, a window sealing assembly and method having tool utilization and spatial recognition for more uniformly sealing portions of the IGU.

BACKGROUND

Insulating glass units (IGUs) are used in windows to reduce heat loss from building interiors during cold weather. IGUs are typically formed by a spacer assembly sandwiched between glass lites. A spacer assembly usually comprises a spacer frame extending peripherally about the unit, a sealant material adhered both to the glass lites and the spacer frame, and a desiccant for absorbing atmospheric moisture within the unit. The margins or the glass lites are flush with or extend slightly outwardly from the spacer assembly. The sealant extends continuously about the spacer frame periphery and its opposite sides so that the space within the IGUs is hermetic. The sealant provides a barrier between atmospheric air and the IGU interior, which blocks entry of atmospheric water vapor.

Typically, sealant is manually applied around a majority of the spacer frame periphery, while leaving a small opening formed through the spacer frame uncovered, or free from sealant. The atmospheric air is evacuated and an inert gas is inserted into the space within the IGU. A rivet or screw is inserted into the opening, and additional sealant is then applied over the uncovered area. Particulate desiccant is typically deposited inside the spacer frame and communicates with air trapped in the IGU interior to remove the entrapped airborne water vapor, and as such, precludes condensation within the unit. Thus, after the water vapor entrapped in the IGU is removed, internal condensation only occurs if the unit fails. The sealant over the uncovered area is typically where IGUs have failed because atmospheric water vapor infiltrated the sealant barrier, such as when the new or second pass sealant over the uncovered area is not hot enough to create a bond with the previously applied sealant, the new sealant is applied unevenly, and/or the like. Additionally, the sealant may be applied unevenly when edges of the glass lites are not co-planar, or otherwise uneven.

Such sealant issues are discussed in U.S. Pat. Pub. No. 2017/0071030 to Briese et al., which is assigned to the assignee of the present disclosure and is incorporated herein by reference. Sealant dispensing, utilizing a sealant metering pump, is discussed in further detail in U.S. Pat. No. 7,048,964, to McGlinchy et al., which is assigned to the assignee of the present disclosure and is incorporated herein by reference

SUMMARY

One example embodiment of the present disclosure includes a window sealing system for use in sealing insulating glass units (IGUs). The sealing system has an articulating arm having a plurality of members and arms to allow movement about multiple axes defined by the articulating arm, and a sealant dispensing apparatus releasably couplable to the articulating arm. The sealant dispensing apparatus comprising a pivotable dispensing element for dispensing sealant onto an IGU, and a vision system, coupled to the sealant dispensing apparatus, for monitoring physical properties of the sealant during sealant application.

Another example embodiment of the present disclosure comprises a method of constructing a window sealing system for use in sealing insulating glass units (IGUs), the method comprising the steps of assembling a sealant dispensing apparatus comprising a releasably couplable element configured to be coupled to an articulating arm and a pivotable dispensing element for dispensing sealant onto an IGU, coupling a vision system to the sealant dispensing apparatus, for monitoring physical properties of the sealant during sealant application, and connecting the vision system, the articulating arm, and the sealant dispensing apparatus to a controller. The controller is configured to receive information from the vision system and instruct the articulating arm based upon the information.

Yet another example embodiment of the present disclosure includes an apparatus for applying a sealant material over an outer surface of an insulating glass unit. The apparatus comprising a source of sealant material, a nozzle for dispensing sealant material from the source onto an outer surface of an insulating glass unit, and a valve for regulating sealant flow from the source to the nozzle. The apparatus further includes a drive for providing relative movement between the nozzle and the insulating glass unit as the nozzle dispenses sealant onto the outer surface, a controller coupled to the drive for adjusting the drive speed to regulate deposition of sealant onto the insulating glass unit, and a sensor for determining a location of the outer surface to appropriately position the nozzle for dispensing of the sealant.

While another aspect of the present disclosure includes an apparatus for applying a sealant material over an outer surface of an insulating glass unit. The apparatus comprises a source of sealant material; a nozzle for dispensing sealant material from the source onto an outer surface of an insulating glass unit; a valve for regulating sealant flow from the source to the nozzle; a drive for providing relative movement between the nozzle and the insulating glass unit as the nozzle dispenses sealant onto the outer surface; a controller coupled to the drive for adjusting the drive speed to regulate deposition of sealant onto the insulating glass unit; a sensor for determining a location of the outer surface to appropriately position the nozzle for dispensing of the sealant; and a smoothing apparatus coupled to the drive, the smoothing apparatus comprising a heating element, wherein the drive provides relative movement between the smoothing apparatus and the insulating glass unit as the heating element interacts with sealant on the outer surface.

BRIEF DESCRIPTION OF THE DRAWINGS

The foregoing and other features and advantages of the present disclosure will become apparent to one skilled in the art to which the present invention relates upon consideration of the following description of the invention with reference to the accompanying drawings, wherein like reference numerals refer to like parts unless described otherwise throughout the drawings and in which.

Figure 1:
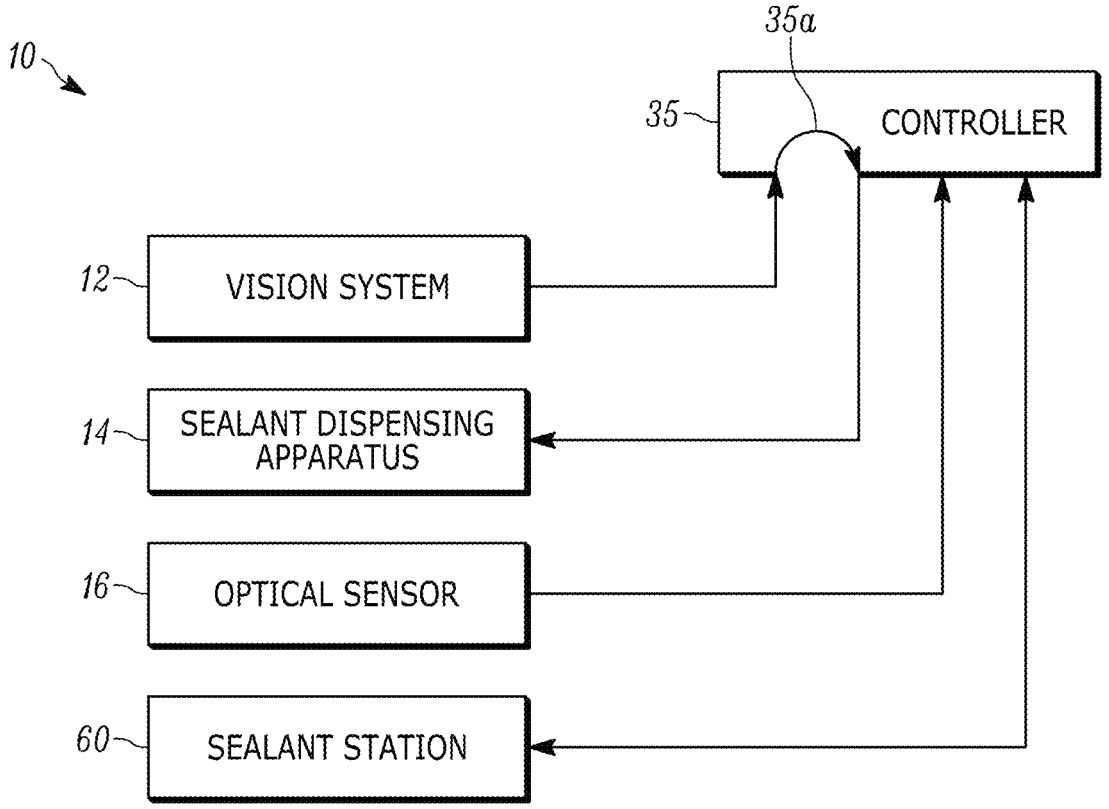
FIG. 1 is an overview schematic block diagram of a sealant processing system.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

The apparatus and method components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DETAILED DESCRIPTION

Referring now to the figures generally wherein like numbered features shown therein refer to like elements throughout unless otherwise noted. The present disclosure relates to an insulting glass unit (IGU) sealing system and method, and more particularly, a window sealing assembly and method having tool utilization and spatial recognition for more uniformly sealing portions of the IGU.

FIG. 1 schematically depicts a window sealing system 10 for sealing window frames or insulating glass units (hereinafter IGUs 100). The IGUs 100 comprise one or more glass lites 210, 212, spaced by a spacer frame 201 (see FIGS. 13 and 14). In FIG. 14, a portion of the spacer frame 201 on a front face 206 of the IGU 100 was omitted for clarity. The IGU 100 referred herein throughout is a selected one of a plurality of IGUs in an assembly line or being presented in a cart or fixtures to the sealing system 10. The select one IGU 100 may have the same or differing size, number of panes or lites, etc. from the plurality of IGUs. The sealing system 10 as described herein is capable of discriminating between IGUs differences, such as the sizes and types to perform the same operation as described on the IGU 100.

During assembly, applied sealant 200 in a prior operation cures around the entire outer peripheral walls the spacer frame 201 except for a small uncovered area 209. Within the uncovered area 209 is an opening 203 through the spacer frame 201 (see FIG. 14). Atmospheric air is evacuated from the opening 203, after which an inert gas is then inserted the opening into the space 207 within the IGU 100 (e.g., bounded by the spacer frame 201 and the glass lites 210, 212). A rivet, screw, cover, or other fastener 205 is inserted into the opening 203, and sealant 40 is automatically applied over the uncovered area 209 and bonded with the applied sealant 200 by the window sealing system 10.

The window sealing system 10 includes a sealant station 60, comprising an articulating arm 62, a vision system 12, a sealant dispensing apparatus 14, and an optical sensor 16 in communication with a controller 35. The articulating arm 62 is selectively couplable to at least one of the optical sensor 16, the sealant dispensing apparatus 14, or the visions system 12. In one example embodiment, the vision system 12 includes a camera capable of detecting pixel count of a targeted area. The pixel count being analyzed by the controller 35 to perform an operation as would be appreciated by one of ordinary skill in the art. In another example embodiment, the vision system 12 is a laser scanner.

Typically, the optical sensor 16 is actuated (e.g., via the articulating arm 62) to move into various positions relative to different parts of an IGU 100 (see FIG. 4) presented as one of many different size and types of IGUs to be processed within a fixture, rack, or mobile cart 64. In the illustrated embodiment, the optical sensor 16 identifies a portion of the IGU that has a different optical property than the rest of the IGU (e.g., the uncovered area 209 that lacks sealant 40) (see, for example, FIG. 13) and records the coordinates of the portion (e.g., the coordinate are stored by the controller 35). The coordinates identify a location in three-dimensional space that the controller 35 can find repeatedly when the IGU 100 is stationarily positioned in the fixture 64. Once the coordinates are identified, the sealant dispensing apparatus 14 is actuated (e.g., via the articulating arm 62) to the coordinates (e.g., responsive to instruction by the controller 35). The sealant dispensing apparatus 14 dispenses sealant 40 over an area designated by the coordinates (see FIG. 14A). Concurrently, the vision system 12 monitors physical properties of the sealant 40, such as the temperature of the sealant, and/or an amount of sealant overflowing from the designated area and the sealant dispensing apparatus 14. The vision system 12 generates a feedback loop 35*a* with the controller 35, wherein the controller instructs the sealant dispensing apparatus 14 to adjust an application speed of the sealant 40, a flow rate of the sealant, a temperature of the sealant, or the like to account for changes in the observed physical properties of the sealant and maintain optimal sealant application conditions.

Figure 2:
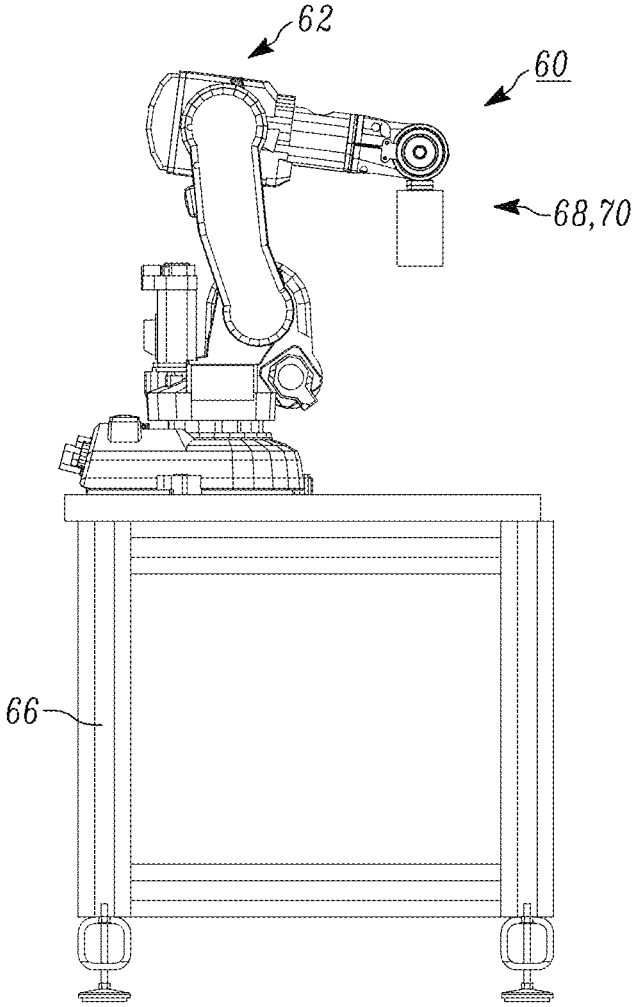
FIG. 2 is a right side elevation view of a sealing station in accordance with one example embodiment of the present disclosure.
Figure 3:
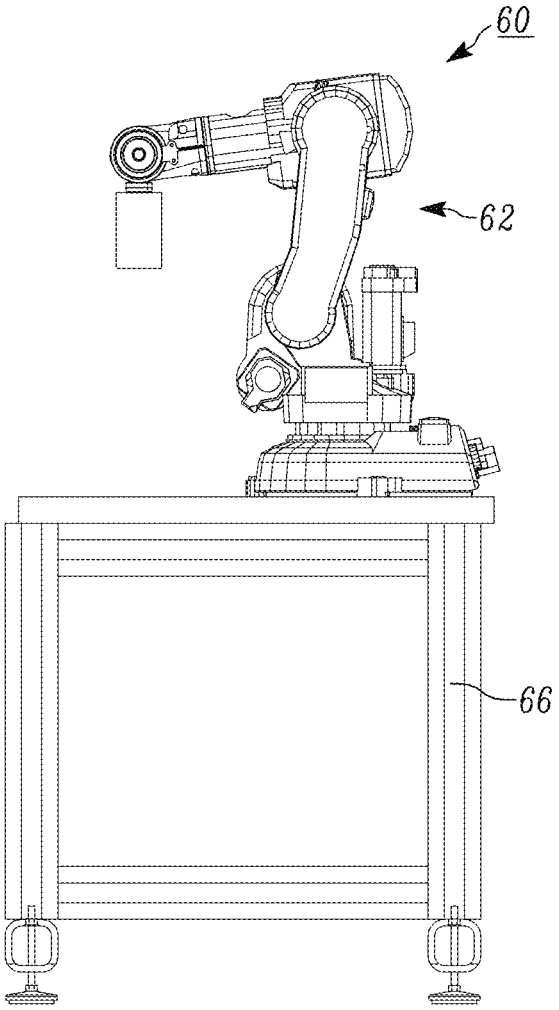
FIG. 3 is a left side elevation view of the sealing station of FIG. 2.
Figure 4:
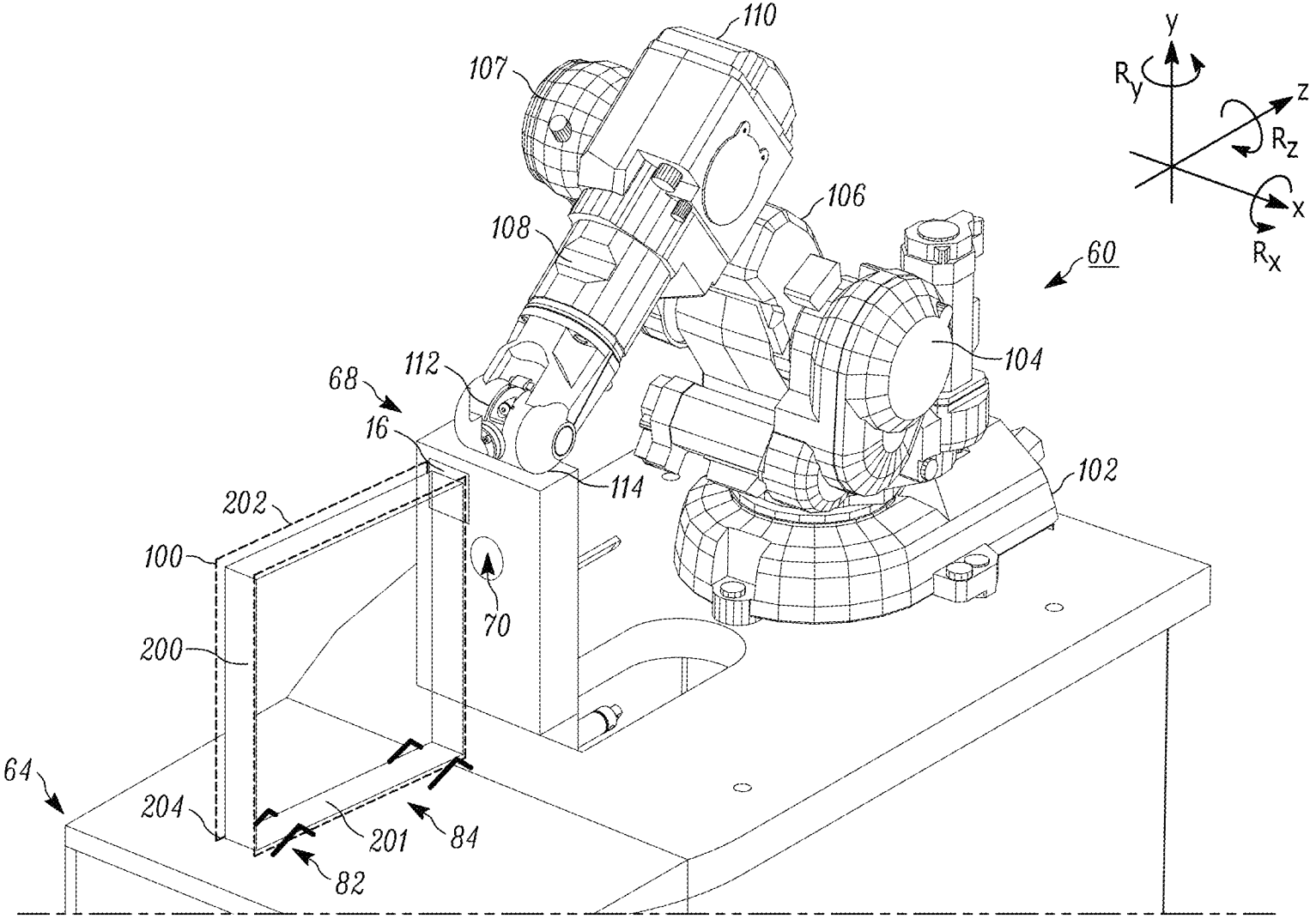
FIG. 4 is a perspective view of the sealing station of FIG. 2.

Views of the sealant station 60 constructed in accordance with one example embodiment of the present disclosure are illustrated in FIGS. 2-4 The sealant station 60 comprises the articulating arm 62, a support stand 66, and a tool support assembly 68. The tool support assembly 68 includes a tool support arrangement 70 for selectable coupling to selectable components comprising the optical sensor 16, the sealant dispensing apparatus 14, and/or the vision system 12. The selectable couplable components are enabled and actuated by instructions from the controller 35 to translate and rotate into a position relative to selected portions of an IGU 100. The controller 35 instructs or directs the operation of the optical sensor 16, the sealant dispensing apparatus 14, and the vision system 12, and various functions associated therewith.

In the illustrated example embodiment, the articulating arm 62 is a six-axis articulating arm, that is, the arm is capable of translation in the X, Y, and Z axial directions as well rotation about each axis Rx, Ry, Rz, as illustrated by the coordinate system illustrated in FIG. 4. The sealant station 62 includes a base 102, a first member 104, a first arm 106, a second member 107, a second arm 108, and a third member 112. The base 102 rotates about the Y axis, thus rotating the first member 104, first arm 106, second member 107, second arm 108, third member 112, and tool support assembly 68. The first member 104 rotates about the X axis, thus rotating the first arm 106, second member 107, second arm 108, third member 112, and tool support assembly 68. The second member 107 rotates about the X axis, thus rotating the second arm 108, third member 112, and tool support assembly 68. The third member 112 rotates about the X axis, thus rotating the tool support assembly 68.

Secured to the third member 112 is a coupling 114 that is mechanically attachable to the tool support assembly 68. The arm 62 rotates about the Y axis, thus rotating the coupling 114 and tool support assembly 68. Each of the selectable couplable components 12, 14, 16 can be oriented to rotate about the Z axis when needed. In one example embodiment, the articulating arm is a six-axis arm manufactured by ABB of Zurich, Switzerland sold under part number ABB-IRB140.

In the illustrated example embodiment, areas with differing topography of the IGU 100 placed at the sealing station 60 are identified by the visual sensor 16. In one exemplary embodiment, the visual sensor 16 includes a laser, which scans along a line of the IGU 100 profile (see FIG. 4) or a camera based visual sensor that images an entire region of the spacer frame 201. Other alternate embodiments utilize tactile or touch sensors for determining the spacer frame profile. In the illustrated example embodiment, the visual sensor 16 identifies areas of the IGU 100 comprising a different profile. The profiling of the IGU 100 by the visual sensor 16 in one example embodiment occurs when the IGU is supported in a frame securing assembly 64.

Referring to FIG. 4, the frame securing assembly 64 includes a number of clamps and corresponding pins for fixing an IGU 100 in place. For example, the frame securing assembly 64 has fixed clamps or fencing 82 and 84 that contact an outer surface of the IGU 100 in a region of one or more corners of the IGU. The IGU 100 has top and bottom surfaces 202, 204, respectively that are oriented within the frame securing assembly 64 in a generally vertical plane with respect to a shop floor. In an example embodiment, the IGUs 100 will be positioned such that the face of the IGU comprising the opening 203, and thus, the uncovered area 209 lacking sealant 40, faces the articulating arm 62. Further details of the fixed clamps 82 and 84 and their operation is found in U.S. Pat. Nos. 8,250,023 and 7,921,064, which are assigned to the assignee of the present disclosure and both patents are incorporated herein by reference for all purposes in their entireties.

Figure 5:
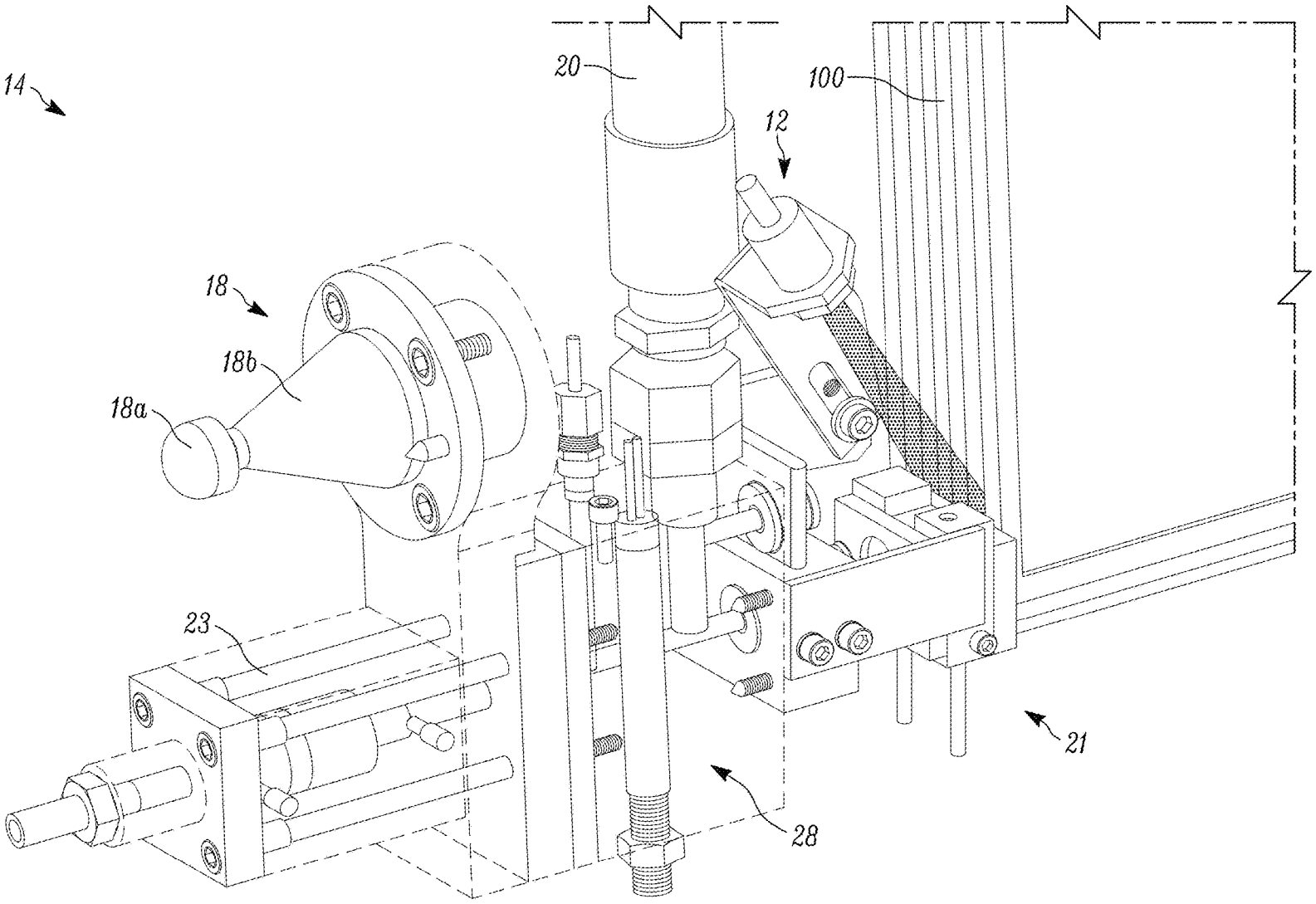
FIG. 5 is a rear perspective view of a sealant dispensing apparatus and vision system.
Figure 6:
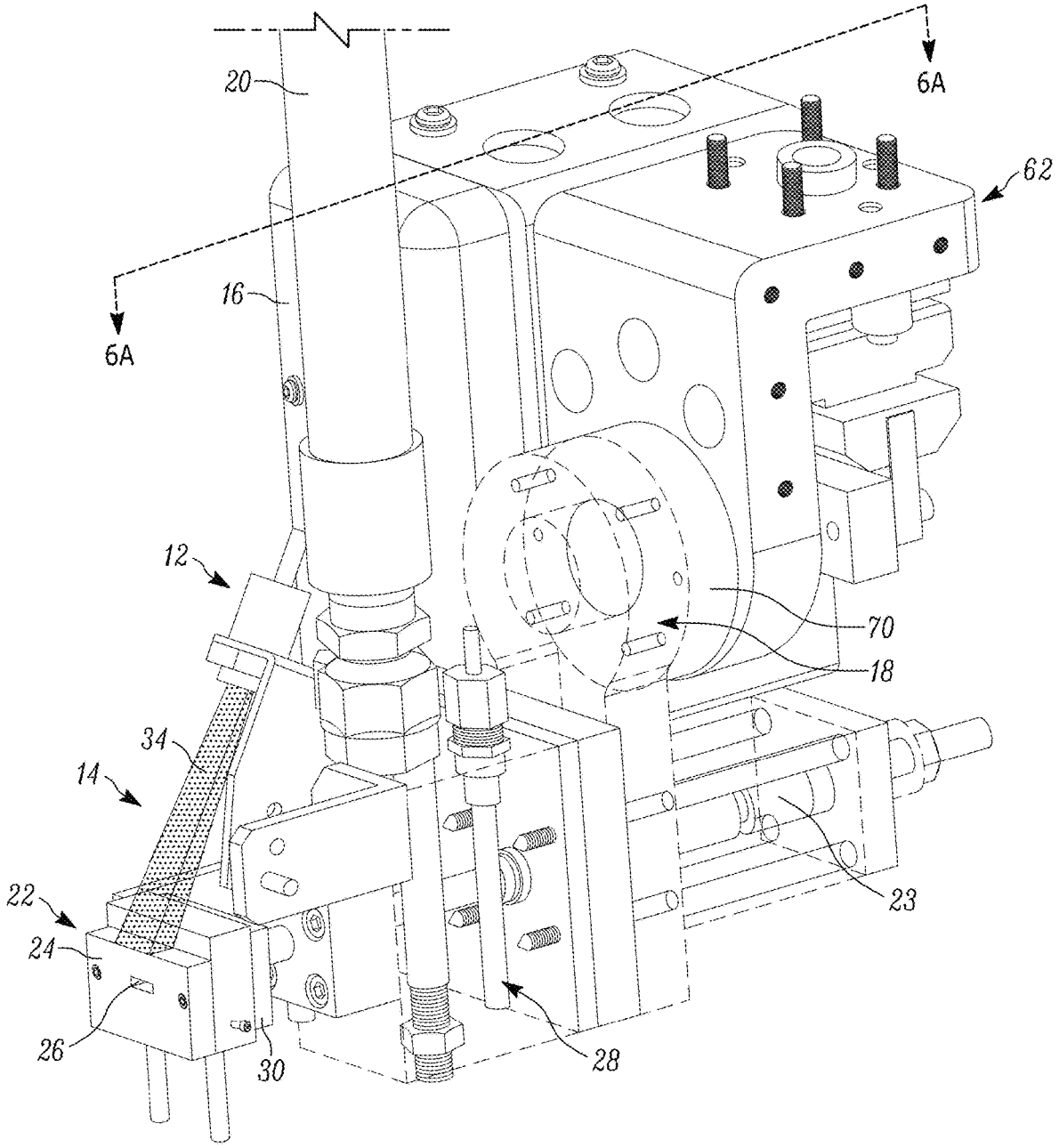
FIG. 6 is a front perspective view of a sealant dispensing apparatus and vision system coupled to the sealing station of FIG. 2.
Figure 6A:
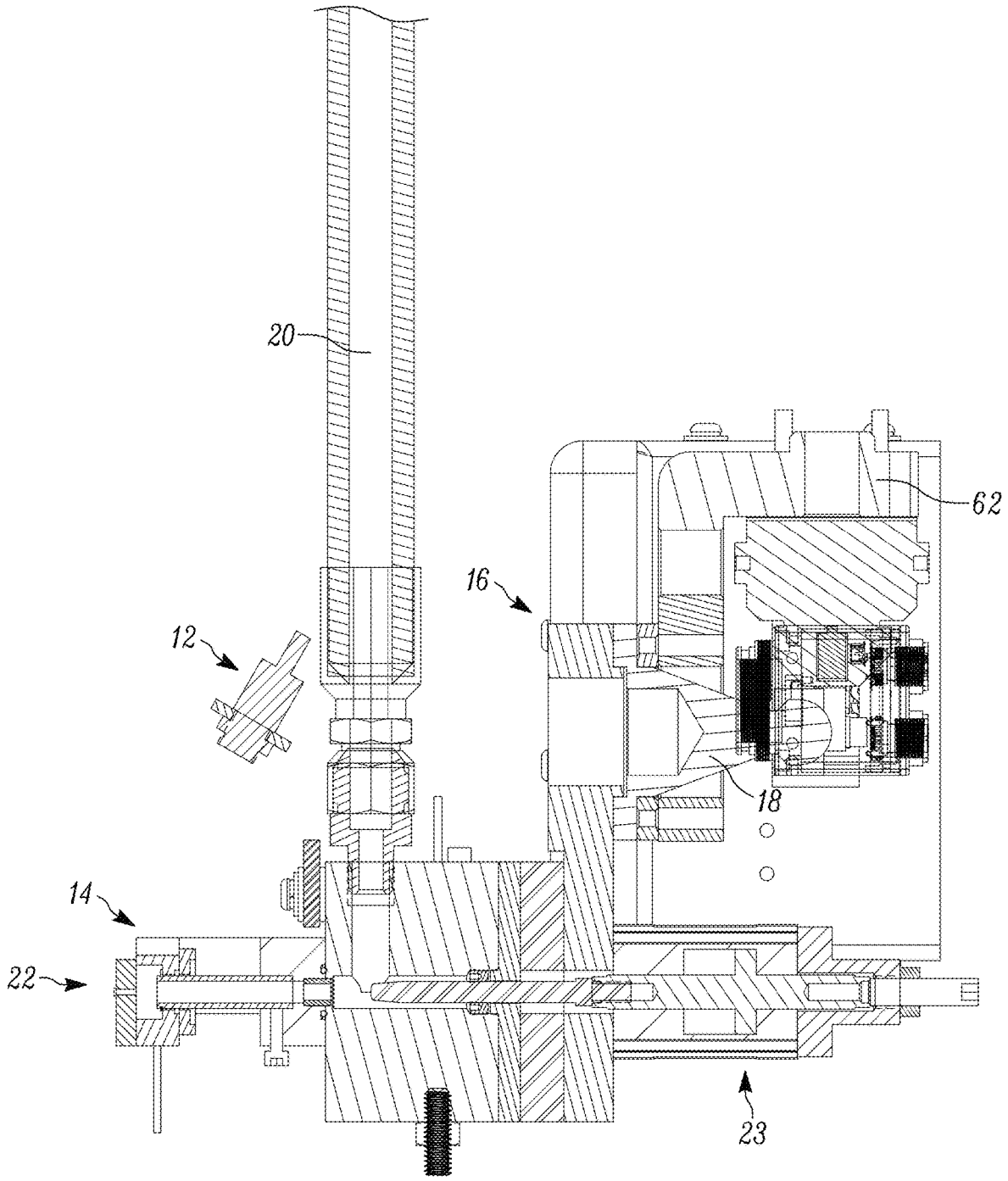
FIG. 6A is a is a section view of FIG. 6 taken along section lines 6A-6A.
Figure 7:
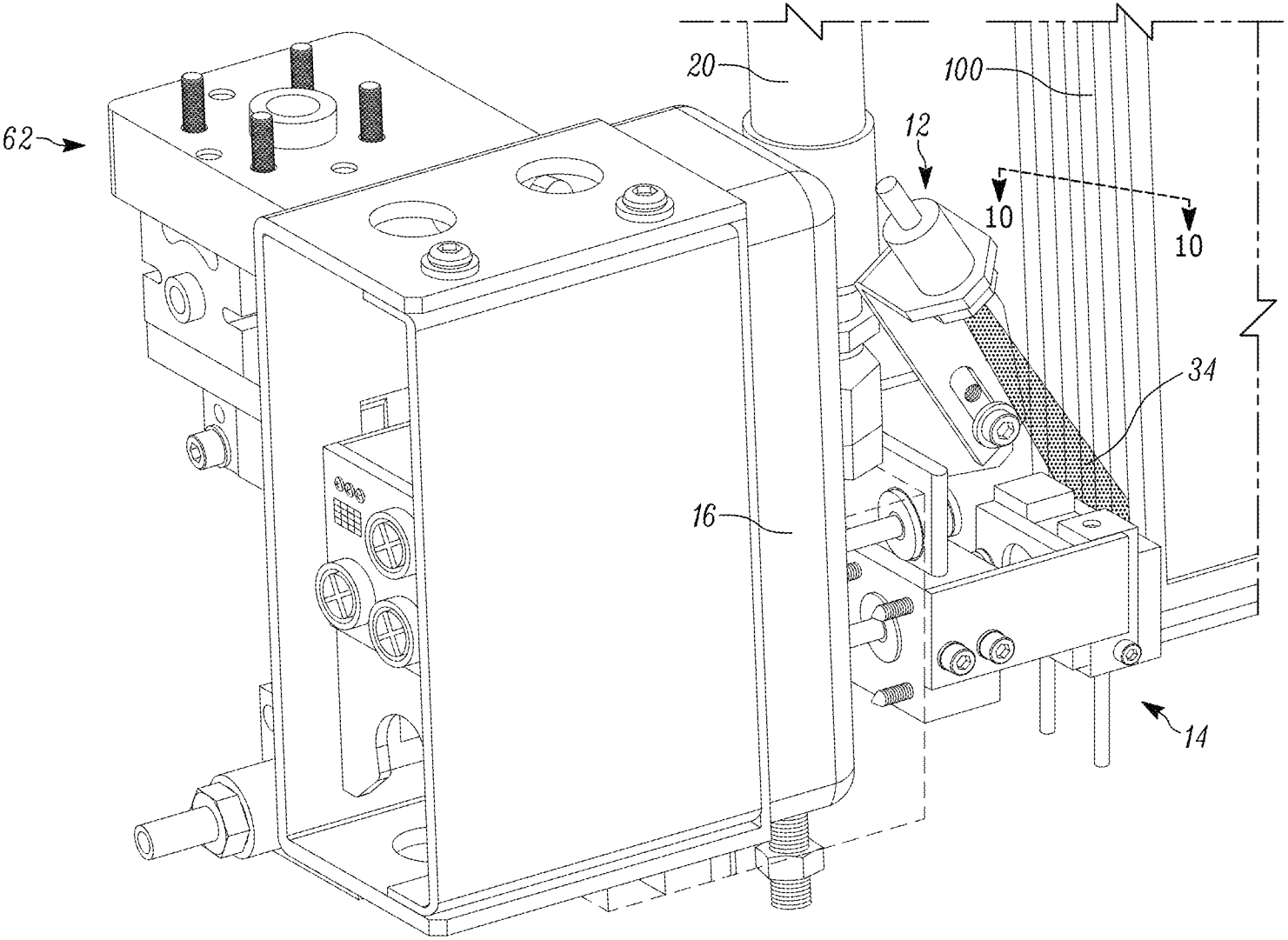
FIG. 7 is a rear perspective view of FIG. 6.

Referring to FIGS. 5-13, the sealant dispensing apparatus 14 comprises a tool connector 18, a dispensing head 21 for depositing sealant 40 on the IGU 100, a sealant valve 28 fluidly connected to the dispensing head, a cylinder 23 for opening and closing the sealant valve, and a sealant input 20 connected to a sealant reservoir (not shown). Referring to FIGS. 5 and 6, the tool connector 18 of the sealant dispensing apparatus 14 is configured to be releasably coupled to the articulating arm 62 via the tool support arrangement 70. The tool connector 18 comprises a cone shaped portion **18*b* abutting a nose portion 18*a*. The tool support arrangement 70 interacts with at least one of the nose portion 18*a* and the cone shaped portion 18*b* to secure the sealant dispensing apparatus 14, such that the sealant dispensing apparatus is controlled in three dimensional space by the articulating arm 62 until the sealant dispensing apparatus is uncoupled. The sealant dispensing apparatus 14 has a home location having coordinates known by the controller 35. The home location comprises a rack or holder on which the sealant dispensing apparatus 14 rests. The articulating arm 62 couples to the sealant dispensing apparatus 14 when it is located at the home location for movement to a dispensing position in relation to the IGU 100. The articulating arm 62 then places the sealant dispensing apparatus at the home location after the sealant 40** has been dispensed.

When the sealant 40 is being dispensed, the sealant valve 28 is opened by the cylinder 23 to allow sealant 40 from the sealant input 20 to flow through a nozzle 26 and from the dispensing apparatus 14 that programmably moved by the controller 35 (while applying the sealant along the uncovered area 209). Once the uncovered area 209 is covered with sealant 40, the sealant valve 28 is closed stopping sealant from going from the sealant input 20 to the nozzle 26. An example of a suitable sealant valve is manufactured by GED Integrated Solutions, Inc. under part number 2-32978 having a nozzle stem under part number 3-33092 and a nozzle seat under part number 3-24754. In one example embodiment, the controller 35 instructs the cylinder 23 when to open or shut the sealant valve 28 responsive to information from the vision system 12. In the illustrated example embodiment, responsive to the cylinder 23 being retracted, the sealant valve 28 is open and sealant 40 is applied at the nozzle 26 and responsive to the cylinder being extended, the sealant valve is closed.

Referring again to FIGS. 5-13, the dispensing head 21 comprises heating elements 31, 32, 33, a flexible attachment hose 30 fluidly coupled to the sealant valve 28, and thus the sealant input 20, the flexible attachment hose runs through the heating elements, a dispensing element 22 comprising a nozzle 26 coupled to the flexible attachment hose for dispensing sealant 40. The flexible attachment hose 30 is adjacent the heating elements 31, 32, 33 to maintain a fluid state of the sealant 40 during application of the sealant to the IGU 100 and maintains a sufficient temperature of the sealant to ensure bonding between the newly applied sealant and the previously manually applied solidified sealant 200. In one example embodiment, the heating elements 31, 32, 33 maintain a temperature between about 275° F. to about 475°

F., and the sealant 40, when leaving the nozzle 26, has a temperature above 350° F. In another example embodiment, a front face heating element 51 is present above the nozzle 26 on a front face 24 of the dispensing head 21, wherein the front face heating element further interacts with the sealant 40 during application to maintain the temperature of the sealant between about 275° F. to about 475° F. It would be appreciated by one having ordinary skill in the art that though first and second heating elements are nearer the dispensing element 22, and the hose 30 is between the third heating element 33 and the first and second heating elements, multiple heating element configurations are contemplated. For example, having less than or more than three heating elements, having the heating elements together on one or the other side of the hose 30, etc.

As in the illustrated example embodiment of FIGS. 9-12, the flexible attachment 30 is buttressed by one or more springs 30A, 30B (e.g., a coil spring wrapped around the attachment, tensions springs, extension springs, etc.). The one or more springs 30A, 30B support the dispensing element 22, and thus the nozzle 26, while allowing the dispensing element 22, the one or more heating elements 31, 32, and/or the front face heating element 51 to pivot, compress, expand, translate and/or rotate relative to the x-axis, the y-axis, the z-axis and the IGU 100. Thus, the dispensing element 22 remains flush with front side edges 214 of both the first and second glass lites 210, 212, which prevents the sealant 40 from escaping sideways along the x-axis and past the front side edges. As shown in the illustrated example embodiment of FIG. 10A, where the first glass lite 210 and the second glass lite 212 of the IGU 100 have front side 214 edges that are coplanar along a z, x coordinate plane, the dispensing element 22 does not pivot when coming into contact with the front side edges. As shown in the example embodiments of FIGS. 10B-10C, the dispensing element 22 pivots toward a first direction (arrow A) or a second direction (arrow B), responsive to the first and second lites 210, 212 being uneven along the z, x coordinate plane. In FIG. 10B, responsive to the front edge of the second glass lite 212 extending further from the spacer frame 201 than the first glass lite 210, the dispensing element 22 pivots in the first direction (arrow A) to evenly distribute the sealant 40. Conversely in FIG. 10C, responsive to the front edge of the first glass lite 210 extending further from the spacer frame 201 than the second glass lite 212, the dispensing element 22 pivots in the second direction (arrow B) to evenly distribute the sealant 40.

Figure 11A:
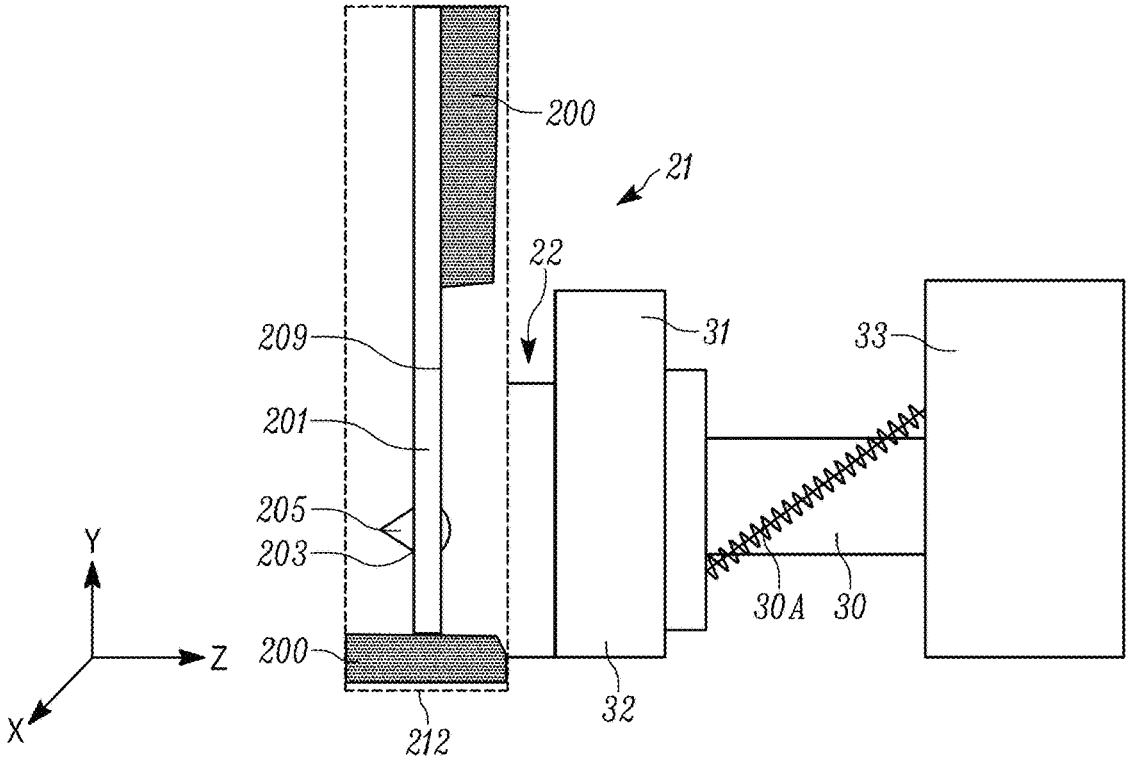
FIG. 11A is a side elevation view of FIG. 10A.
Figure 11B:
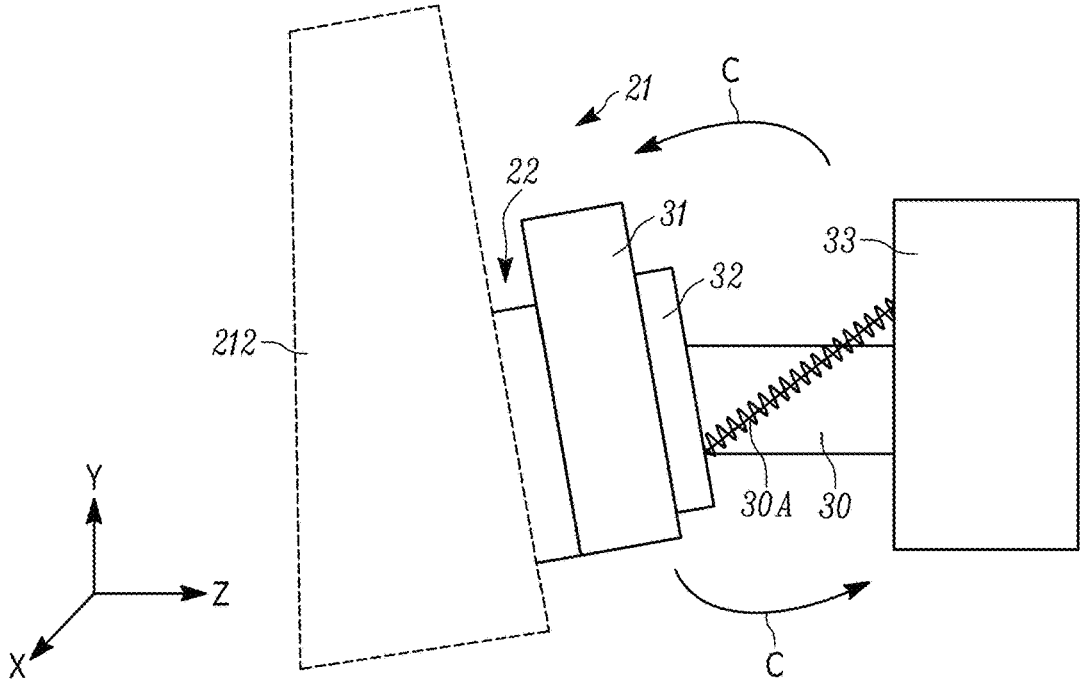
FIG. 11B is a side elevation view of FIG. 11A in a first pivoted position.
Figure 11C:
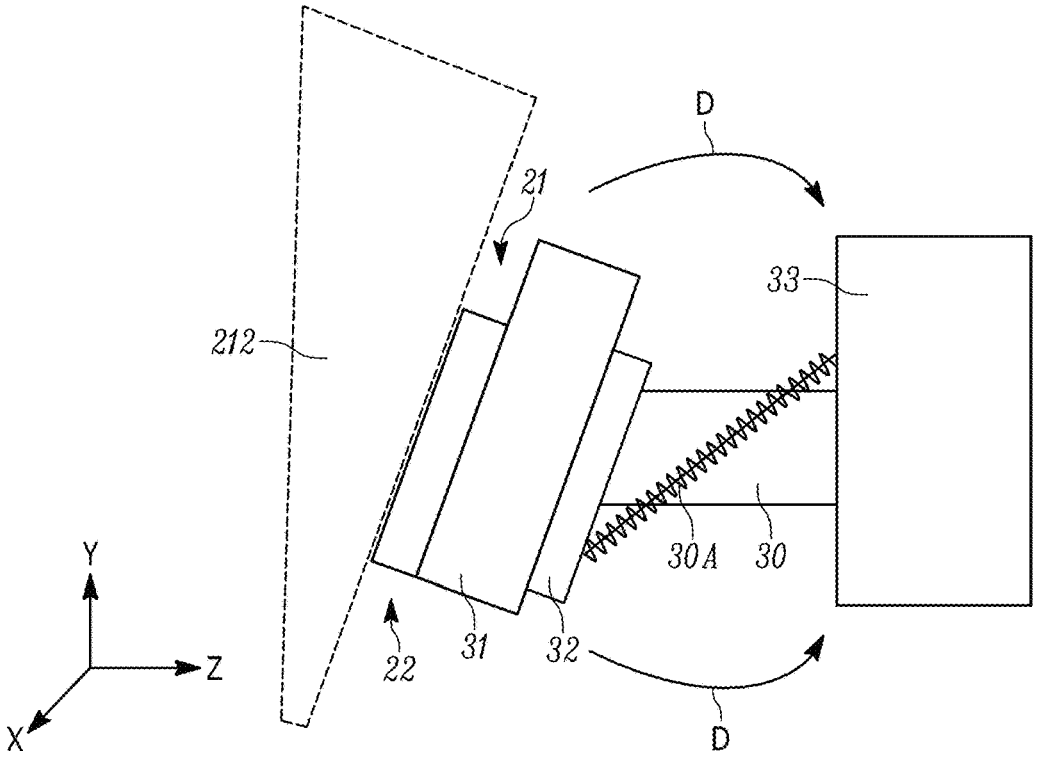
FIG. 11C is a side elevation view of FIG. 11A in a second pivoted position.
Figure 12:
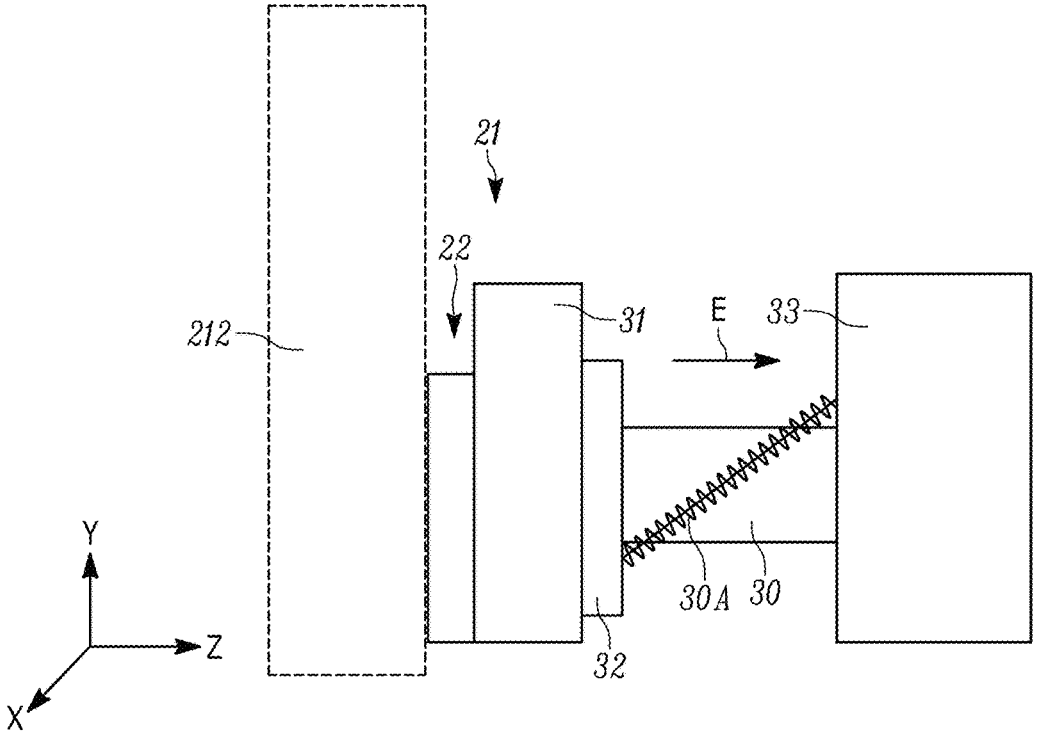
FIG. 12 is a side elevation view of FIG. 11A in a third pivoted position.

Similarly as shown in the illustrated example embodiment of FIG. 11A, where the first glass lite 210 and the second glass lite 212 of the IGU 100 have front side 214 edges that run parallel to the y-axis, the dispensing element 22 does not pivot when coming into contact with the front side edges. When the front side 214 edges are not parallel to the y-axis, the dispensing element 22 pivots as illustrated in FIGS. 11B-11C toward a forward (arrow C) or backward (arrow D) direction to be flush with the front side edges. Additionally, as in the illustrated embodiment of FIG. 12, the dispensing element 22, responsive to encountering the glass lites 210, 212 can move along the z-axis (arrow E) to partially shorten the hose 30, to prevent hitting the glass lites with significant force, or to mitigate a force applied to the lites during contact. It would be appreciated by one having ordinary skill in the art that the dispensing element 22 can concurrently pivot along the y, z coordinate plane, the x, z coordinate plane, and x, y coordinate plane to adjust to various positions of the glass lites 210, 212. Thus, the quality of the seal created by the sealant 40 is uniform even when the glass lites 210, 212 are uneven, tilted, or the like.

The dispensing element 22 comprises the front face 24 in which the nozzle opening 26 is defined. In the illustrated example embodiments of FIGS. 5-13, the front face 24 terminates in a top face 25 of the dispensing element 22 that extends along a plane at a 90° angle relative to the front face. In another example embodiment, the top face 25 extends along a plane that is transverse to the front face 24. The angle of the top face 25 relative to the front face 24 is configured to capture excess sealant 40 in a bead 38, and to help evenly spread the sealant by acting as a sealant spreader/scraper.

Figure 8:
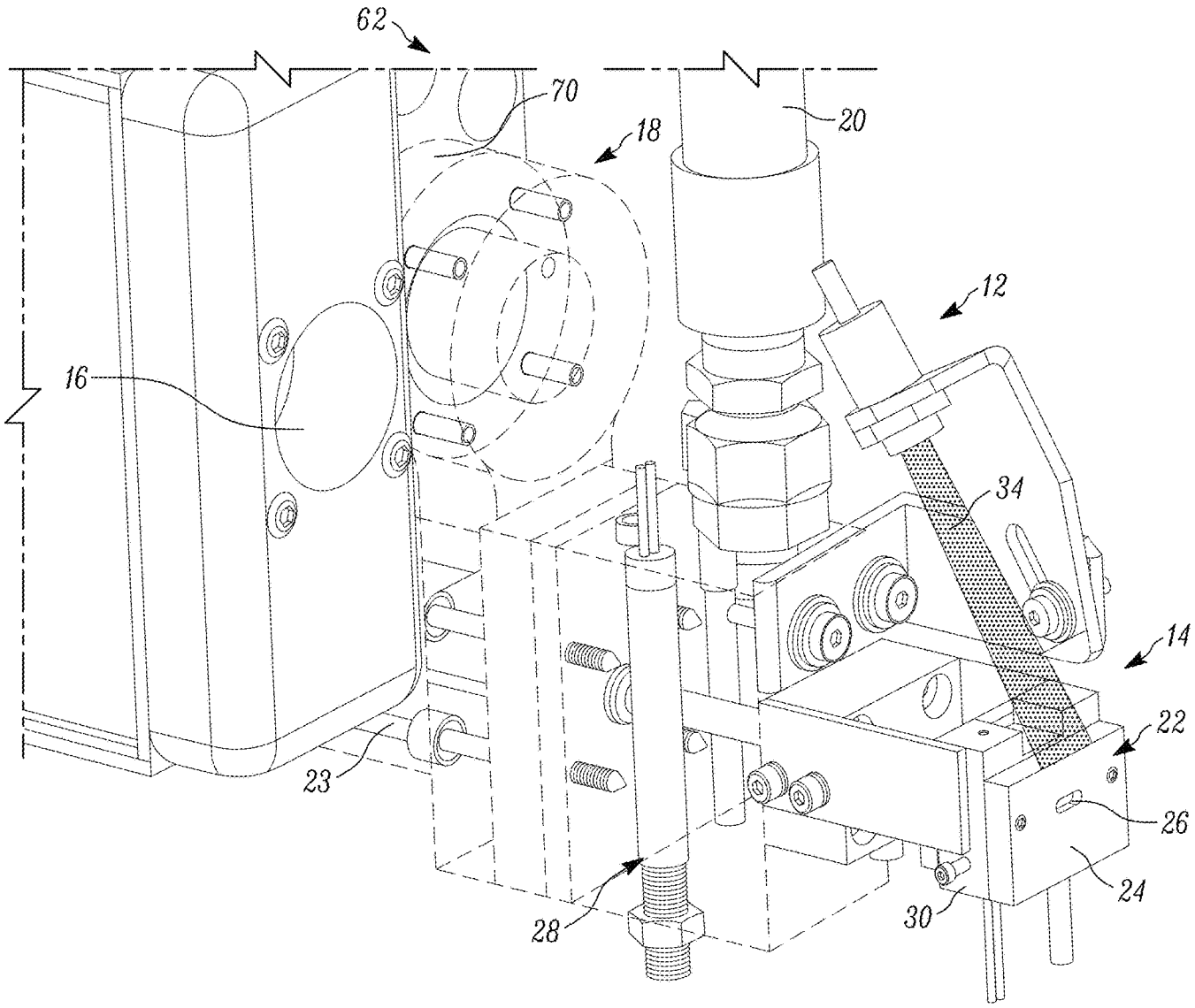
FIG. 8 is a right side perspective view of FIG. 6.
Figure 8A:
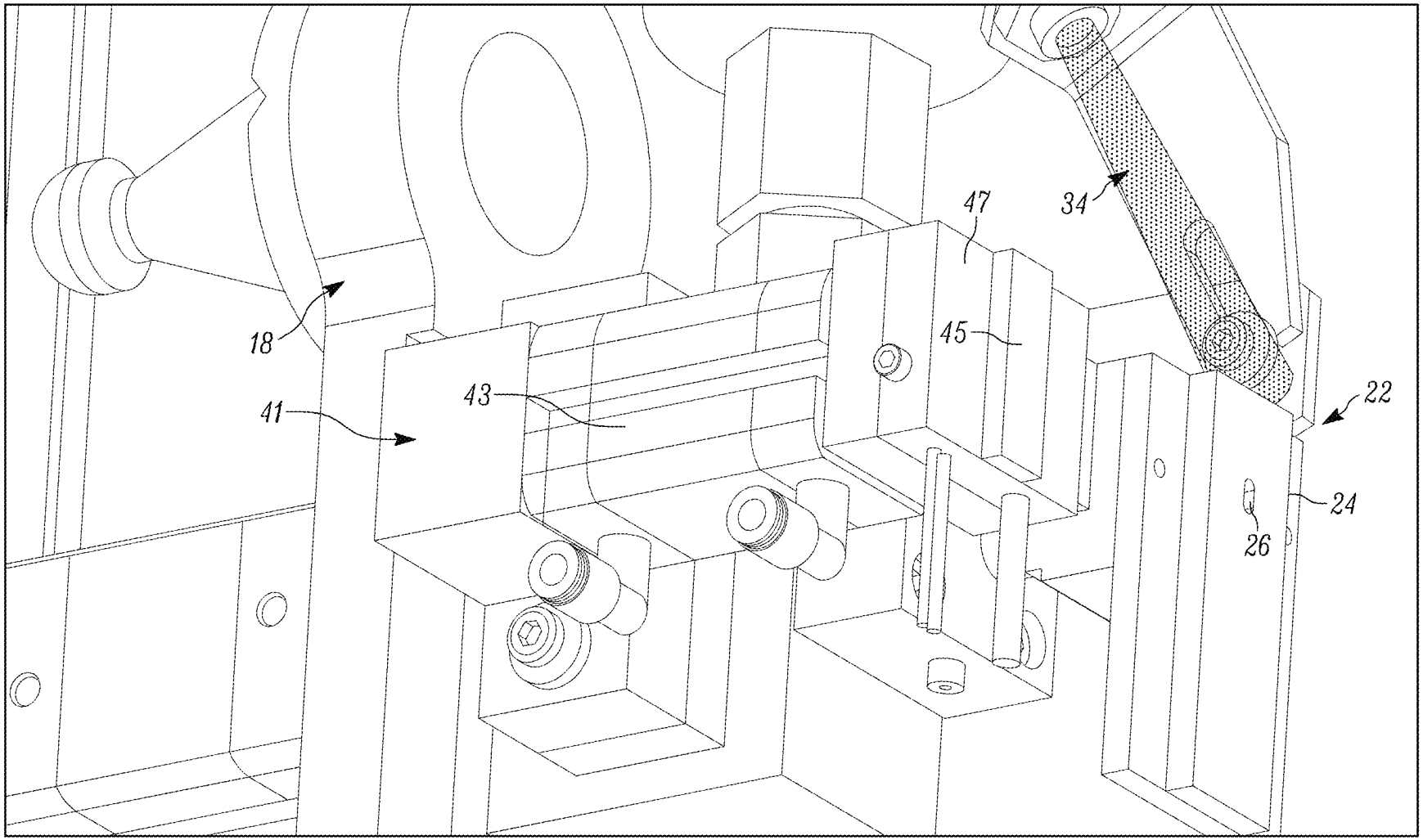
FIG. 8A is a right side perspective view of a sealant dispensing apparatus including a smoothing apparatus and vision system coupled to the sealing station of FIG. 2.
Figure 9:
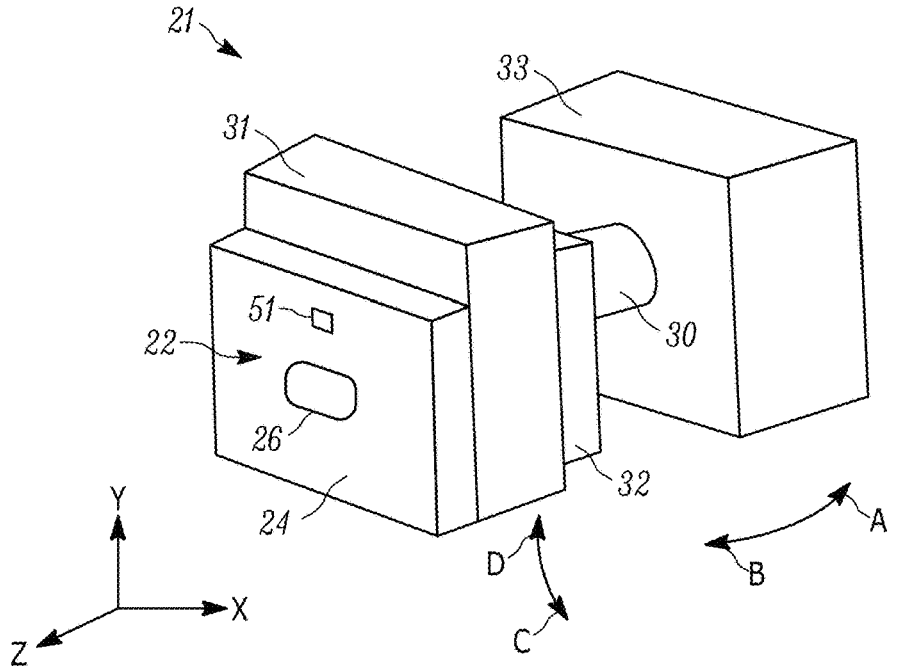
FIG. 9 is a perspective view of a dispensing head of FIG. 7
Figure 10A:
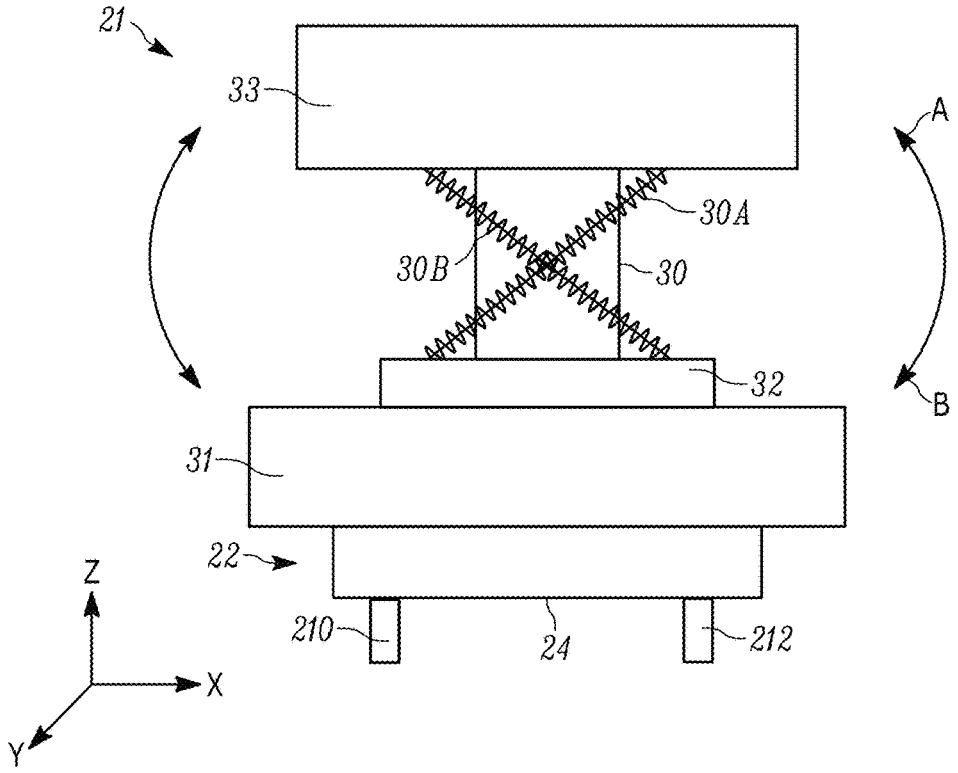
FIG. 10A is a section view of FIG. 7 taken along section lines 10-10.
Figure 10B:
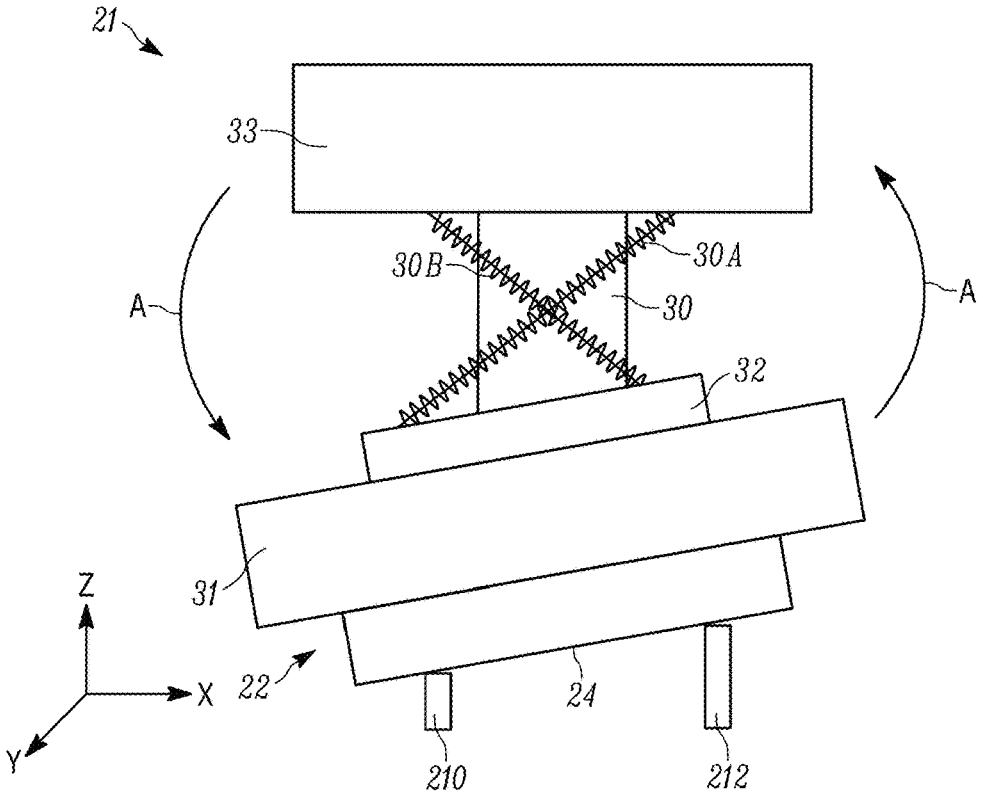
FIG. 10B is a top plan view of FIG. 10A in a first pivoted position.
Figure 10C:
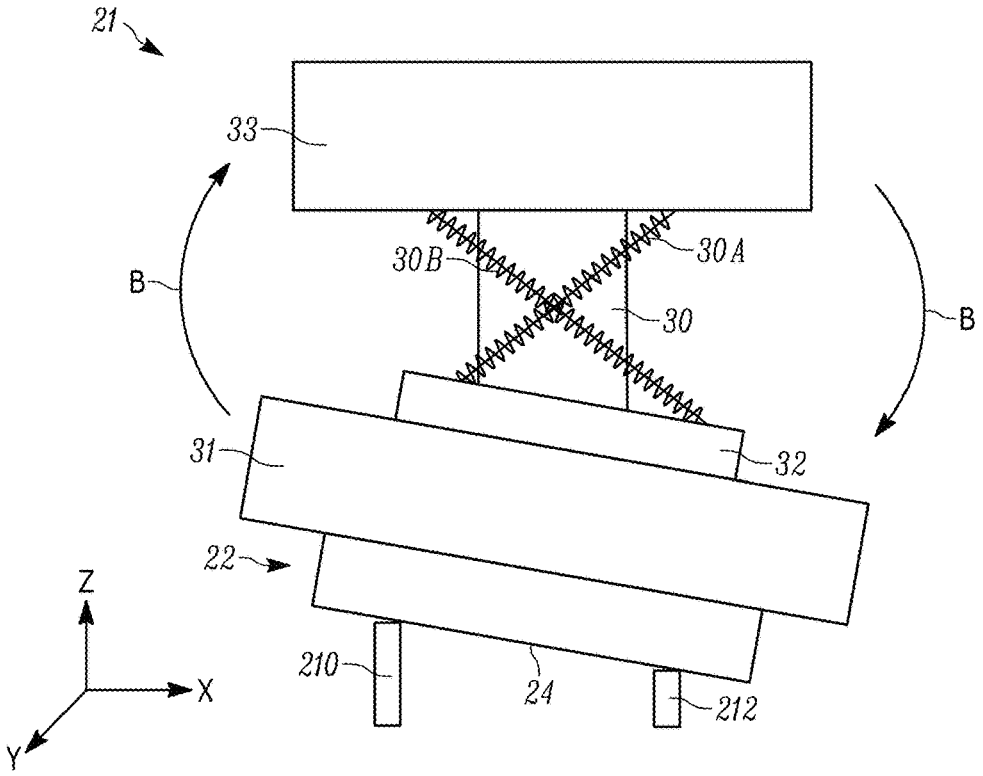
FIG. 10C is a top plan view of FIG. 10A in a second pivoted position.

In the illustrated example embodiment of FIG. 8A, a smoothing apparatus 41 is coupled to the sealant dispensing apparatus 14 via an arm 43. The smoothing apparatus 41 comprises a smoothing element 45 coupled to a front face 47 of the smoothing element. In one example embodiment, the front face 24 of the nozzle 26 is coplanar with the front face 47, the smoothing element 45, or extends in front of the front face of the nozzle in a direction away from the tool connector 18. In one example embodiment, the smoothing element reaches a temperature between about 275° F. to about 475° F. In another example embodiment, the arm 43 comprises a flexible attachment that functions in a same or similar manner as the flexible attachment 30 that supports the dispensing element. The arm 43 supports the smoothing apparatus 41 as it pivots, compresses, expands, translates and/or rotates relative to the x-axis, the y-axis, the z-axis and the IGU 100, responsive to the alignment of the first side edges 214 of both the first and second glass lites 210, 212.

Figure 14:
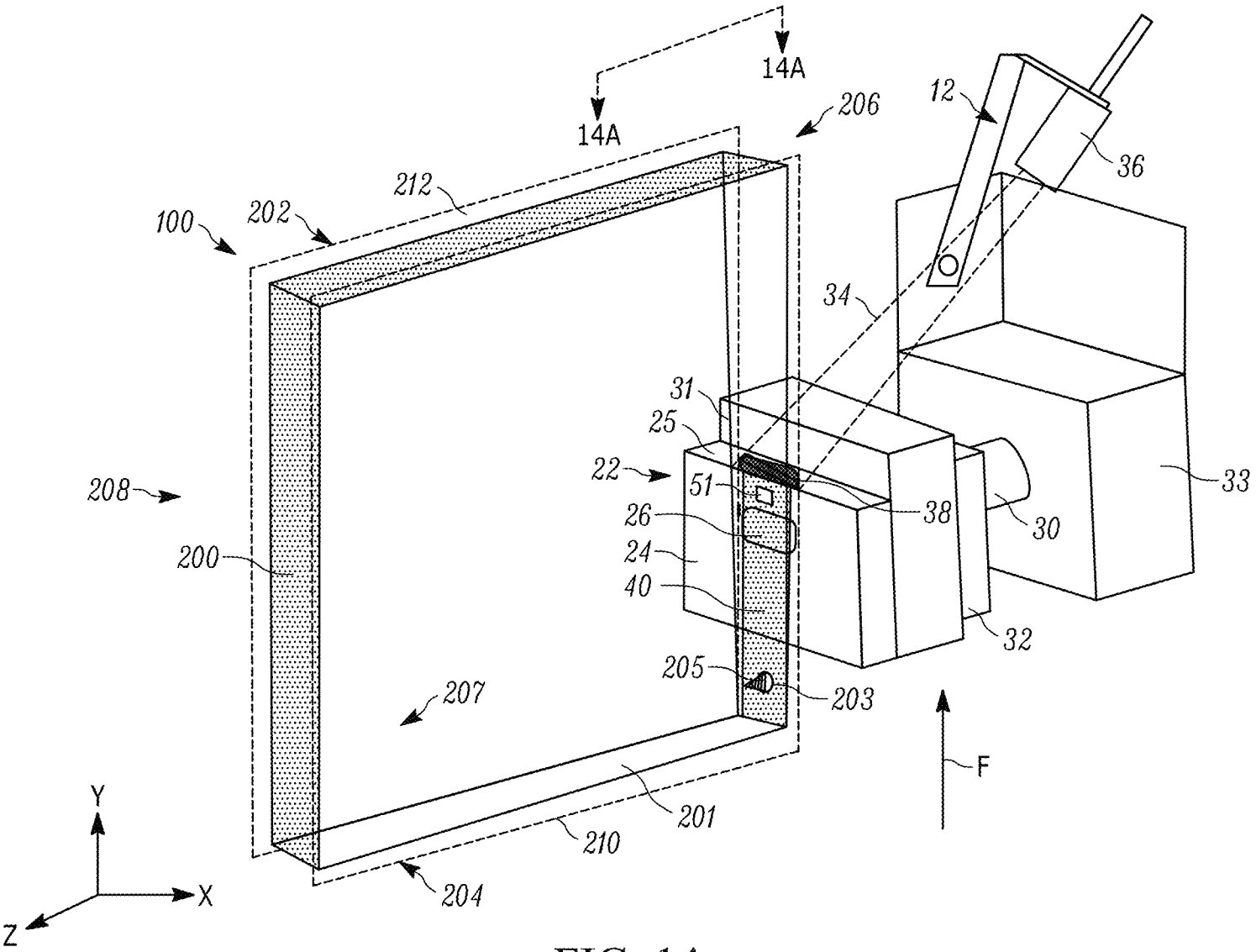
FIG. 14 is a perspective view of a sealant dispensing apparatus dispensing sealant on an IGU wherein a vision system monitors the dispensing.
Figure 14A:
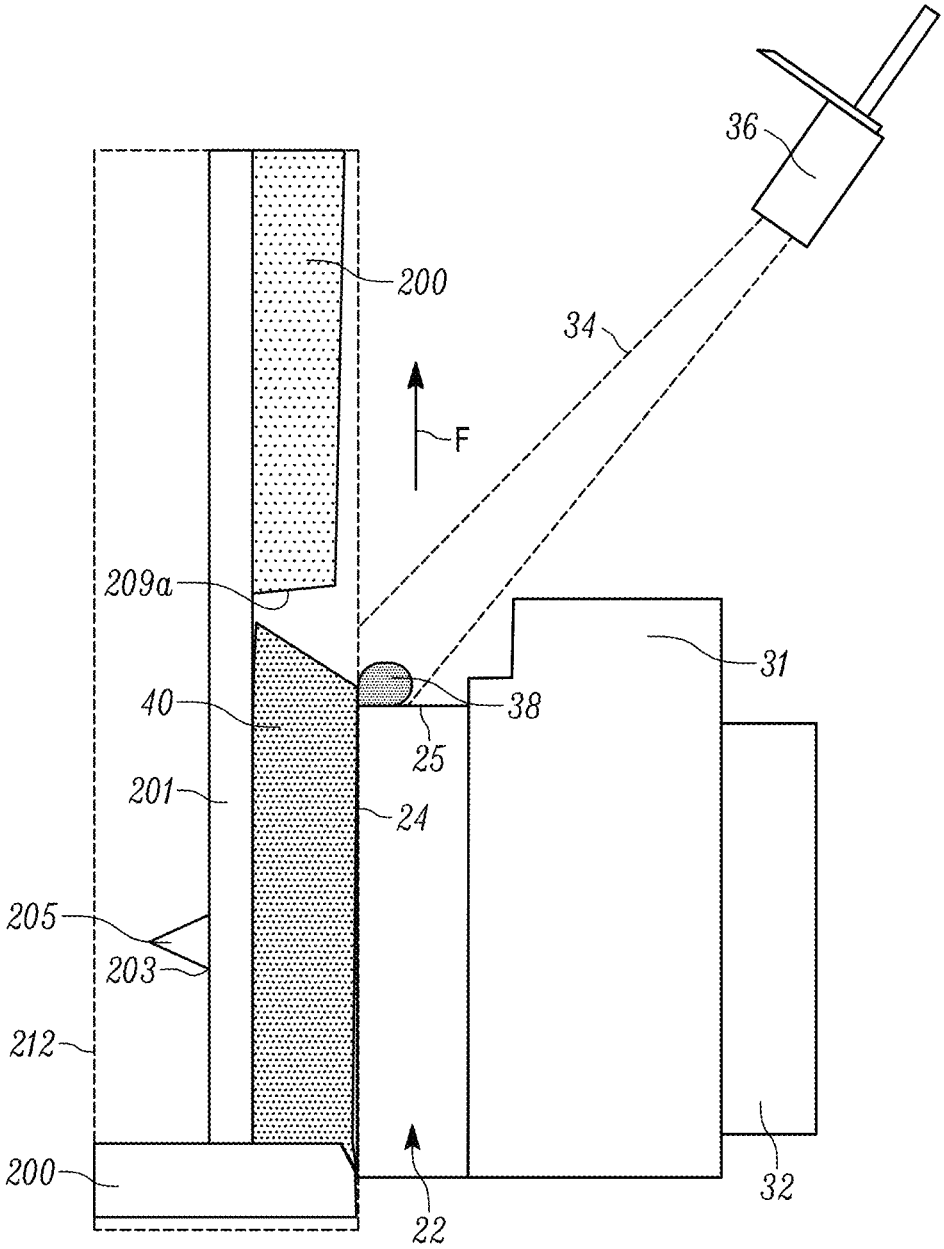
FIG. 14A is a section view of FIG. 14 taken along section lines 14A-14A.

In the illustrated example embodiment of FIGS. 14 and 14A, the vision system 12 is coupled to the sealant dispensing apparatus 14, such that a beam 34 emitted from the vision system interacts with the top face 25 of the nozzle 26, and/or the bead 38. The vision system 12 comprises a laser vision system and/or an infrared vision system, wherein the vision system emits a laser or an infrared beam and determines a physical property of the bead 38 by capturing refracted/reflected light after the light had interacted with the bead. In one example embodiment, the size of the bead 38 and/or the temperature of the bead is determined and communicated to the controller 35 during use to control the speed or movement of the arm 62 and/or dispensing of the sealant 40 to apply a controlled amount of sealant along the uncovered area 209.

Figure 15:
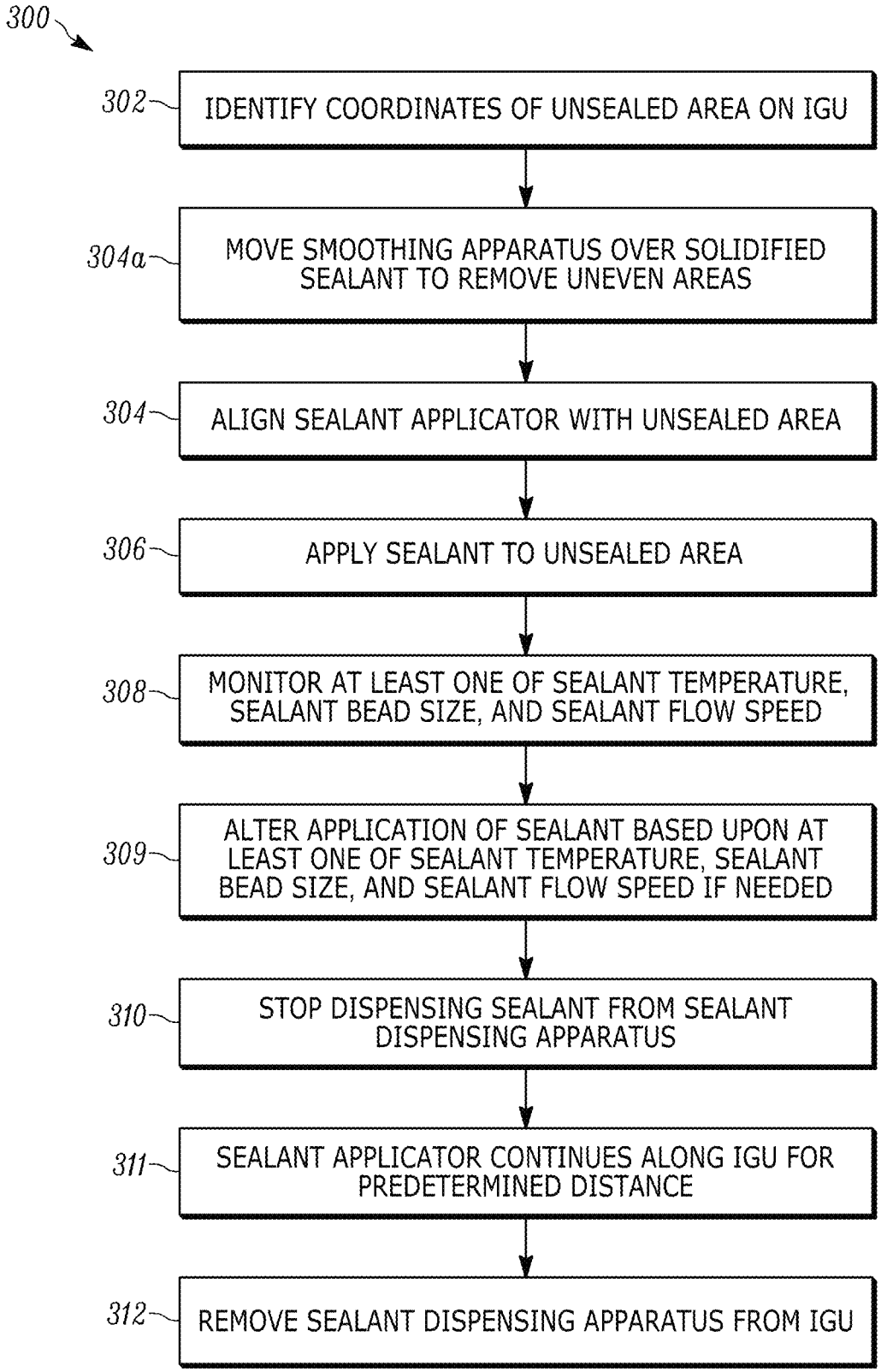
FIG. 15 is a flow diagram of a method of sealant application.

During use, and as illustrated in the example method 300 of FIG. 15, at 302, the coordinates of the uncovered area 209 are determined by the optical sensor 16, the articulating arm 62 will couple to the tool connector 18, to couple the sealant dispensing apparatus 14 to the arm. In one example embodiment, a first sealant dispensing apparatus 14 or a second sealant dispensing apparatus will be selected based upon a width of the IGU, wherein the first and second sealant dispensing apparatuses have different nozzles 26, having different widths and/or dimensions configured to interact with a given IGU 100 of a plurality of IGUs, the IGU having a particular width. At 304*a*, the articulating arm 62 will move the sealant dispensing apparatus 14 such that the smoothing apparatus 41 abuts the IGU 100 over the uncovered area 209. The articulating arm 62 will move the smoothing apparatus 41 over the solidified sealant 200 and the uncovered area 209 to smooth any uneven areas (e.g., bumps or lumps) in the solidified sealant by heating the sealant to a liquefying or viscous temperature and smoothing the heated sealant to remove the bumps or lumps. In one example embodiment, method step 304*a* is optional, and performed when the optical sensor 16 detects the lump or bump. In another example embodiment, method step 304*a* is performed whether the optical sensor 16 detects the lump or bump or does not detect such an imperfection.

Figure 13:
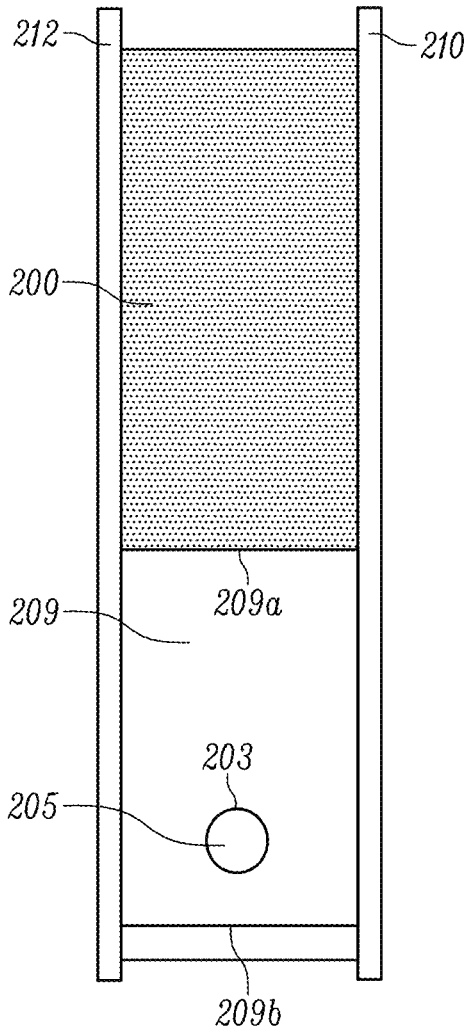
FIG. 13 is a front elevation view of a partially constructed insulating glass unit (IGU)

At 304, the articulating arm 62 will move the sealant dispensing apparatus 14 such that the front face 24 abuts the IGU 100 over the uncovered area 209 (see FIGS. 13, and 14A). The nozzle 26 is aligned at a first or second end 209*a*, 209*b*, respectively, of the uncovered area 209, where the sealant 200 is present but not of sufficient thickness, or not present (see FIG. 13). It would be appreciated by one having ordinary skill in the art, that though IGUs 100 having double pane glass is shown, multi-pane IGUs (e.g., such as triple pane windows having two spacer frames and three glass lites) are contemplated and would be sealed in a same manner as the double pane IGUs.

The nozzle 26 is aligned to dispense sealant 40 beginning at the second end 209*b* (see FIG. 13). At 306, the nozzle 26, once aligned, starts dispensing sealant 40 while moving along the edges of the first and second lites 210, 212, in a first dispensing direction (arrow F) along the y-axis. As the sealant dispensing apparatus 14 is moved along the first dispensing direction (arrow F) excess sealant 40 forms the bead 38. At 308, the vision system 12 detects physical properties of the bead 38. At 309, the application of the sealant 40 is altered based upon the physical properties of the bead 38, for example, if the bead is too big, the controller 35 will determine that too much sealant 40 is being dispensed or the sealant dispensing apparatus 14 is moving too slowly. In such instances, the controller 35 will adjust one of the flow speed of the sealant, or increase the speed at which the sealant dispensing apparatus 14 is moving. In another example, if the bead 38 is too small, the controller 35 will determine that too little sealant 40 is being dispensed or the sealant dispensing apparatus 14 is moving too quickly for optimal sealant deposition. In such instances, the controller 35 will increase one of the flow speed of the sealant, or decrease the speed at which the sealant dispensing apparatus 14 is moving.

In yet another example, if the vision system 12 sends information to the controller 35 that indicates that the temperature of the bead 38 is too low (e.g. for optimal bonding with the solid state sealant 200), the controller will alter the heat being applied by the heating elements 31, 32, 33, increase the flow rate of the sealant 40 (e.g., by increasing the pressure on the sealant in the sealant dispensing apparatus 14), and/or increase the speed at which the sealant dispensing apparatus 14 is moving along the dispensing direction (arrow F). At 310, the controller 35 instructs the sealant dispensing apparatus 14 to stop dispensing sealant 40. The sealant dispensing apparatus 14 stops dispensing sealant 40 gradually, or abruptly, responsive to the information sent to the controller 35. At 311, the sealant dispensing apparatus 14 continues moving along the edges of the first and second lites 210, 212, in the first dispensing direction (arrow F) after the sealant dispensing apparatus has stopped dispensing sealant 40. In one example embodiment, the sealant dispensing apparatus 14 continues moving along the edges of the first and second lites 210, 212 for a predetermined distance (e.g., a distance equal to the length of the dispensing apparatus 22). In another example embodiment, the sealant dispensing apparatus 14 continues moving along the edges of the first and second lites 210, 212 until the controller 35 receives information from the vision system 12 that the bead 38 has shrunk or disappeared. In this way, the dispensing apparatus 22 wipes/cleans itself before returning to step 302.

At 312, the sealant dispensing apparatus is removed from the IGU 100 once the sealant has been dispensed, for example, responsive to the coordinates indicating the sealant dispensing apparatus 14 has reached the first end 209*a*, the nozzle 26 stops dispensing sealant 40 (e.g., by the controller 34 instructing the cylinder 21 to extend to close the sealant valve 28). In one example embodiment, the front face 24 of the dispensing element 22 maintains contact with the edges of the IGU 100 and continues moving along the dispensing direction (arrow F) until the vision system 12 indicates that the bead 38 is a stop dispensing size (e.g., as indicated by a pre-programmed variable in the controller 35). In this example embodiment, the controller 35 instructs the articulating arm 62 to continue moving the sealant dispensing apparatus 14 along the dispensing direction (arrow F) until receiving a signal from the vision system 12 to remove the sealant dispensing apparatus 14 from contact with the IGU 100. The movement of the sealant dispensing apparatus 14 along the dispensing direction (arrow F) smoothes the remaining sealant 40 to create an even seal. The sealant dispensing apparatus 14 is returned to the home position and uncoupled from the articulating arm 62. It would be appreciated by one having ordinary skill in the art that the sealant dispensing apparatus 14 could be moved from the first end 209*a* to the second end 209*b*, such as in a second dispensing direction directly opposed to the dispensing direction (arrow F) to dispense sealant 40.

Figure 16:
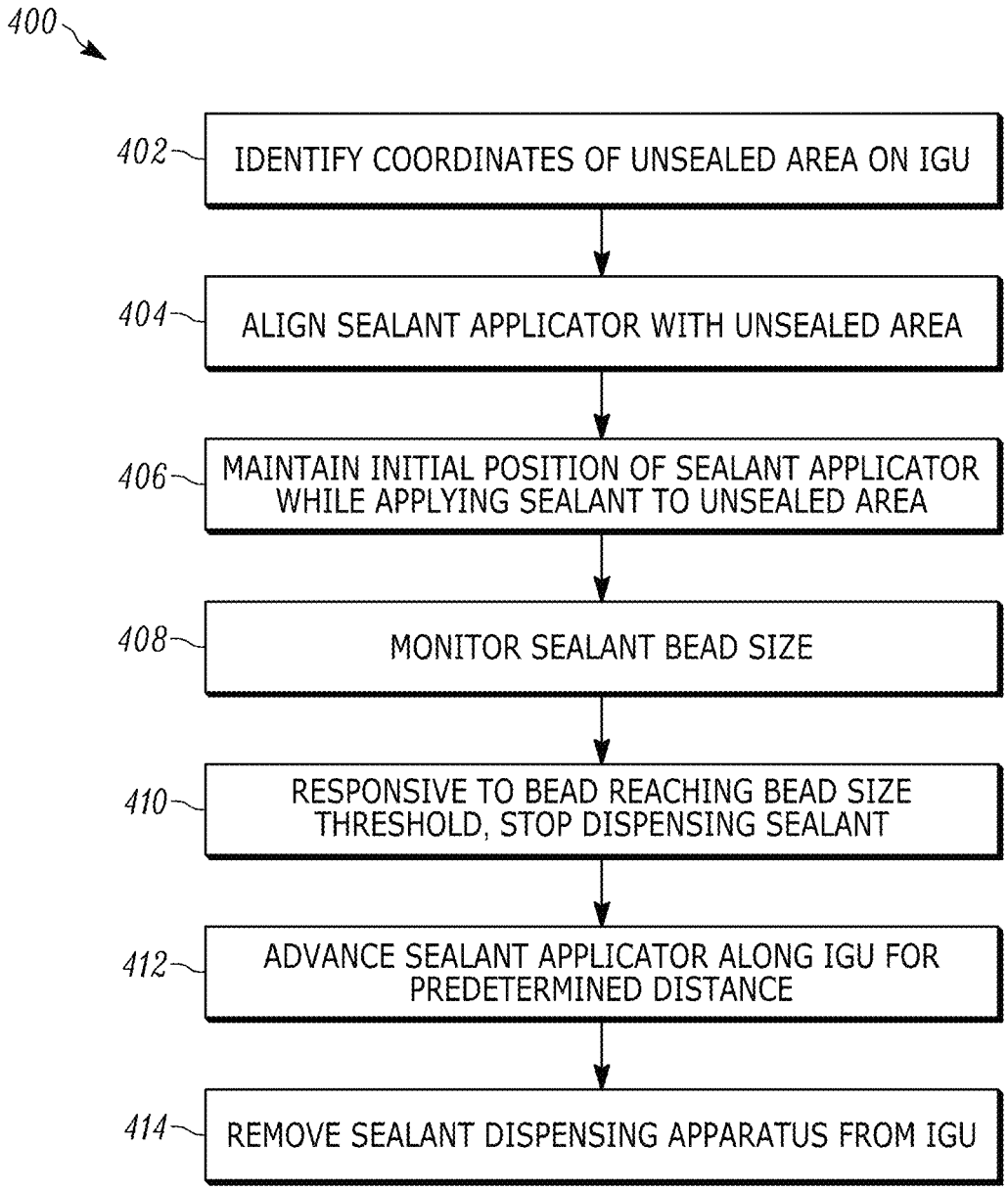
FIG. 16 is a flow diagram of a second method of sealant application.

During use, and as illustrated in a second example method 400 of FIG. 16, at 402, the coordinates of the uncovered area 209 are determined by the optical sensor 16, the articulating arm 62 will couple to the tool connector 18, to couple the sealant dispensing apparatus 14 to the arm. At 404, the articulating arm 62 will move the sealant dispensing apparatus 14 to abut the IGU 100 as described above with regard to step 304 of the example method 300 illustrated in FIG. 15. The nozzle 26 is aligned at an initial position to dispense sealant 40 beginning at the second end 209*b* (see FIG. 13).

At 406, the nozzle 26, once aligned, starts dispensing sealant 40 while maintaining the initial position. As the sealant dispensing apparatus 14 dispenses sealant 40 over the uncovered portion 209 excess sealant 40 forms the bead 38. At 408, the vision system 12 monitors a size of the bead 38 and communicates the size to the controller 35. At 410, responsive to the bead 38 reaching a bead size threshold, the controller 35 instructs the sealant dispensing apparatus 14 to stop dispensing sealant 40. In this embodiment, the sealant dispensing apparatus 14 stops dispensing sealant 40 abruptly, responsive to the information sent to the controller 35.

At 412, the sealant dispensing apparatus 14 starts moving along the edges of the first and second lites 210, 212, maintaining contact with the edges. The sealant dispensing apparatus 14 moves in the first dispensing direction (arrow F) after the sealant dispensing apparatus has stopped dispensing sealant 40. In one example embodiment, the sealant dispensing apparatus 14 continues moving along the edges of the first and second lites 210, 212 for a predetermined distance (e.g., a distance equal to the length of the dispensing apparatus 22). In another example embodiment, the sealant dispensing apparatus 14 continues moving along the edges of the first and second lites 210, 212 until the controller 35 receives information from the vision system 12 that the bead 38 has shrunk or disappeared. In this way, the dispensing apparatus 22 wipes/cleans itself before returning to step 402. At 414, the sealant dispensing apparatus is removed from the IGU 100.

Advantageously, the articulating arm 62 coupled to the sealant dispensing apparatus 14 dispenses the sealant in a reproducible manner. For example, the articulating arm 62 moves the sealant dispensing apparatus 14 at a constant speed, unless the visions system 12 indicates that the speed should be adjusted to achieve a more uniform sealant dispensing. Further, the vision system 12 is able to adjust dispensing factors, such as sealant temperature, sealant dispensing speed, and the speed of the sealant dispensing apparatus 14, during application to prevent dis-uniformity across multiple IGUs. The real-time monitoring by the vision system 12 provides enhanced sealing of the IGUs. During manual sealant application, a user may move the sealant dispensing apparatus 14 too quickly, preventing bonding of the steady state sealant 200 and the sealant 40, or too slowly resulting in overflow of the sealant. The pivotablity of the dispensing element 22 further enhances sealing of the IGUs 100, by allowing the front face 24 of the dispensing element to be flush with the edges of the IGU 100. It should be appreciated that while the IGU 100 is being presented to the sealing system 10 with a first sealant 40 along all sides of the IGU except for the unsealed area 209. The sealing system 10 however has the flexibility and designed in such a way that the system can apply sealant to more than the unsealed area 209 and along all sides of the IGU if desired.

In the foregoing specification, specific embodiments have been described. However, one of ordinary skill in the art appreciates that various modifications and changes can be made without departing from the scope of the disclosure as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The disclosure is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art. In one non-limiting embodiment the terms are defined to be within for example 10%, in another possible embodiment within 5%, in another possible embodiment within 1%, and in another possible embodiment within 0.5%. The term "coupled" as used herein is defined as connected or in contact either temporarily or permanently, although not necessarily directly and not necessarily mechanically. A device or structure that is "configured" in a certain way is configured in at least that way, but may also be configured in ways that are not listed.

To the extent that the materials for any of the foregoing embodiments or components thereof are not specified, it is to be appreciated that suitable materials would be known by one of ordinary skill in the art for the intended purposes.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. A window sealing system for use in sealing insulating glass units (IGUs) comprising:

an articulating arm having a plurality of members and arms to allow movement about multiple axes defined by the articulating arm;

a sealant dispensing apparatus releasably couplable to the articulating arm, the sealant dispensing apparatus comprising;

a pivotable dispensing element for dispensing sealant onto an IGU, the pivotable dispensing element is concurrently pivotable along an x-axis, a y-axis a z-axis relative to a first heating apparatus; and a second heating apparatus configured to interact with the sealant of the IGU; and a vision system, coupled to the sealant dispensing apparatus, for monitoring physical properties of the sealant during sealant application.

2. The window sealing system of claim 1, further comprising an optical sensor selectively couplable to the articulating arm for identifying coordinates of an area of the IGU having a desired topography.

3. The window sealing system of claim 1, wherein a dispensing hose connects the dispensing apparatus to the first heating apparatus.

4. The window sealing system of claim 1, further comprising a smoothing apparatus coupled to the sealant dispensing apparatus for smoothing sealant of the IGU into a desired topography.

5. The window sealing system of claim 4, the smoothing apparatus comprising the second heating apparatus configured to interact with the sealant of the IGU.

6. The window sealing system of claim 4, wherein the smoothing apparatus is concurrently pivotable along an x-axis, a y-axis a z-axis relative to the IGU.

7. The window sealing system of claim 1, wherein the pivotable dispensing element comprises a front face in which a nozzle opening for sealant application is defined.

8. The window sealing system of claim 7, wherein the front face terminates in a top face of the dispensing element that extends along a plane configured to capture excess sealant in a bead during sealant application.

9. The window sealing system of claim 8, the vision system comprising at least one of a laser vision system and an infrared vision system, wherein the at least one of a vision system and an infrared vision system emits a beam and determines a physical property of the bead by capturing at least one of refracted and reflected light after said light had interacted with the bead.

10. A window sealing system for use in sealing insulating glass units (IGUs) comprising:

an articulating arm having a plurality of members and arms to allow movement about multiple axes defined by the articulating arm;

a sealant dispensing apparatus releasably couplable to the articulating arm, the sealant dispensing apparatus comprising a pivotable dispensing element for dispensing sealant onto an IGU; and a vision system, coupled to the sealant dispensing apparatus, for monitoring physical properties of the sealant during sealant application;

a smoothing apparatus coupled to said sealant dispensing apparatus, the smoothing apparatus comprising a heating element, wherein said articulating arm provides relative movement between said smoothing apparatus and said insulating glass unit as the heating element interacts with sealant on an outer surface of the IGU.

11. The window sealing system of claim 10, wherein the pivotable dispensing element is concurrently pivotable along an x-axis, a y-axis a z-axis relative to a second heating apparatus.

12. The window sealing system of claim 11, wherein a dispensing hose connects the dispensing apparatus to the second heating apparatus.

13. A window sealing system for use in sealing insulating glass units (IGUs) comprising:

an articulating arm having a plurality of members and arms to allow movement about multiple axes defined by the articulating arm;

a sealant dispensing apparatus releasably couplable to the articulating arm, the sealant dispensing apparatus comprising;

a pivotable dispensing element for dispensing sealant onto an IGU, wherein the pivotable dispensing element comprises a front face in which a nozzle opening for sealant application is defined, wherein the front face terminates in a top face of the dispensing element that extends along a plane configured to capture excess sealant in a bead during sealant application; and a heating apparatus configured to interact with the sealant of the IGU; and a vision system, coupled to the sealant dispensing apparatus, for monitoring physical properties of the sealant during sealant application.

14. The window sealing system of claim 13, further comprising an optical sensor selectively couplable to the articulating arm for identifying coordinates of an area of the IGU having a desired topography.

15. The window sealing system of claim 13, wherein the pivotable dispensing element is concurrently pivotable along an x-axis, a y-axis a z-axis relative to a second heating apparatus.

16. The window sealing system of claim 15, wherein a dispensing hose connects the dispensing apparatus to the second heating apparatus.

17. The window sealing system of claim 13, further comprising a smoothing apparatus coupled to the sealant dispensing apparatus for smoothing sealant of the IGU into a desired topography.

18. The window sealing system of claim 17, the smoothing apparatus comprising the heating apparatus configured to interact with the sealant of the IGU.

19. The window sealing system of claim 17, wherein the smoothing apparatus is concurrently pivotable along an x-axis, a y-axis a z-axis relative to the IGU.

20. The window sealing system of claim 13, the vision system comprising at least one of a laser vision system and an infrared vision system, wherein the at least one of a vision system and an infrared vision system emits a beam and determines a physical property of the bead by capturing at least one of refracted and reflected light after said light had interacted with the bead.

* * * * *